United States Patent [19]

Creed

[11] 4,099,547

[45] Jul. 11, 1978

[54] CONTAINER FILLING EMPLOYING ANTI-VACUUM FOOT VALVE

[75] Inventor: Sherman H. Creed, San Jose, Calif.

[73] Assignee: FMC Corporation, San Jose, Calif.

[21] Appl. No.: 762,705

[22] Filed: Jan. 26, 1977

[51] Int. Cl.[2] ..... B65B 3/04

[52] U.S. Cl. ..... 141/5; 141/302; 141/392

[58] Field of Search ..... 137/170.1; 141/37-64, 141/115-127, 250-284, 1-12, 144-152, 392, 291-296, 301, 302, 286

[56] References Cited

U.S. PATENT DOCUMENTS 3,285,300 11/1966 Mistarz ..... 137/170.1

*Primary Examiner*—Houston S. Bell

*Attorney, Agent, or Firm*—C. E. Tripp; J. F. Verhoeven

[57] ABSTRACT

A filling machine for filling open top containers with pressurized liquid, especially carbonated liquid, or liquid which readily foams, having rotary turret mounting filling valve assemblies, each of which includes a cylinder with its foot valve and a piston with its plug valve, as generally known in the art. Before filling starts, a measured charge is trapped in a measuring chamber. Each foot valve is provided with a perforate wall exposed to atmosphere on its underside, and a flexible diaphragm overlies the perforated all and is exposed to the filling charge. At the start of the container filling operation, the foot valve is moved downward, while in sealed relation with the cylinder, to first deblock the plug valve and then decompress the measured charge. The foot valve remains sealed with the cylinder after deblocking and decompression, hence continued downward movement of the valve to its open position further enlarges the measuring chamber which would normally draw a vacuum in the chamber so that when the foot valve opened, air bubbles would be drawn up into the charge and cause foaming problems. However, the flexible diaphragm is distended upwardly under atmospheric pressure. This prevents further enlargement of the measuring chamber, no vacuum is drawn therein and air bubbles are not drawn up into the measured charge when filling begins.

27 Claims, 32 Drawing Figures

FIG_10
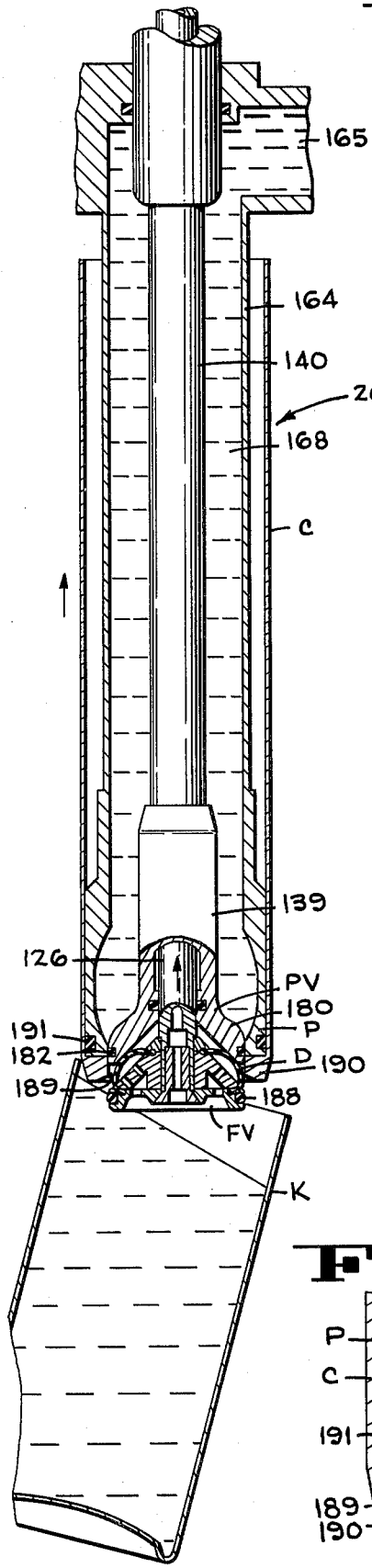
FIG_11
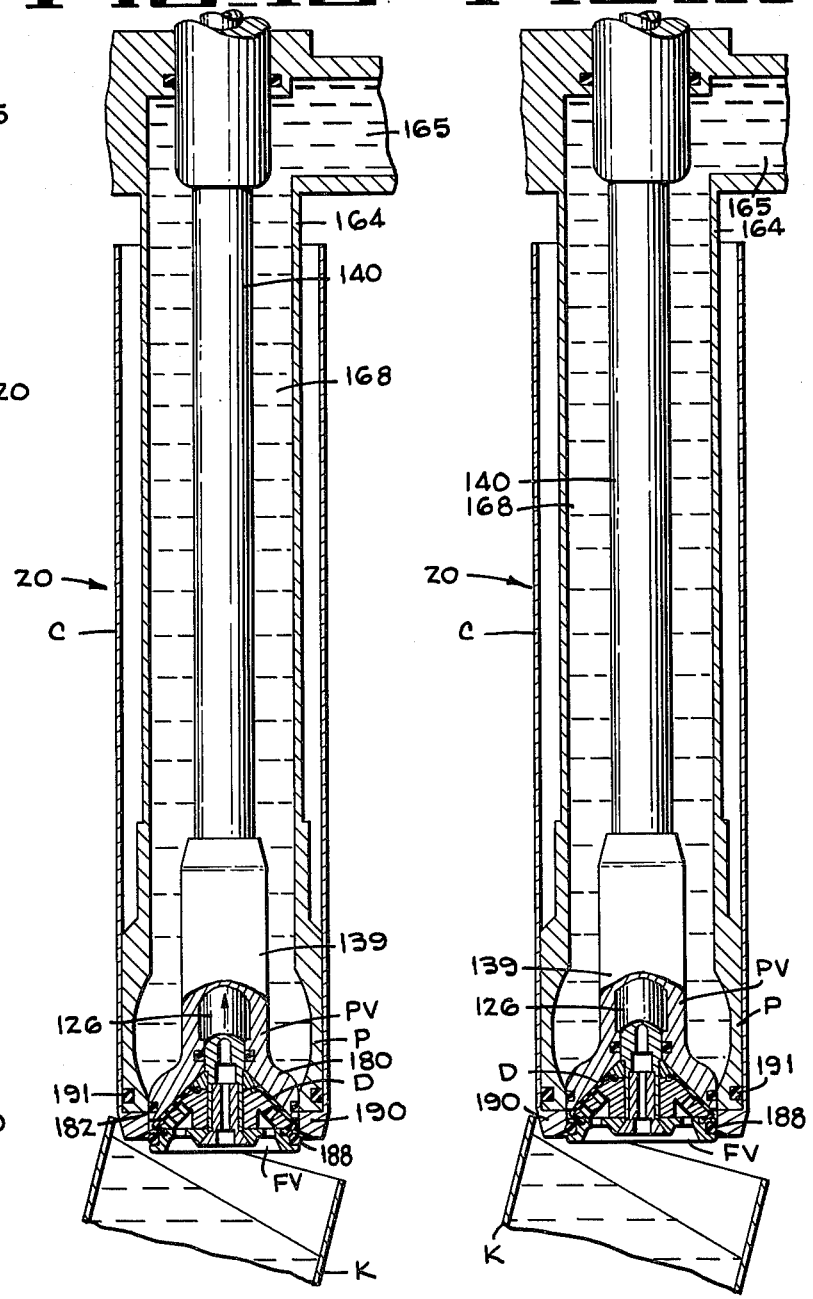
FIG_9
FIG_10A
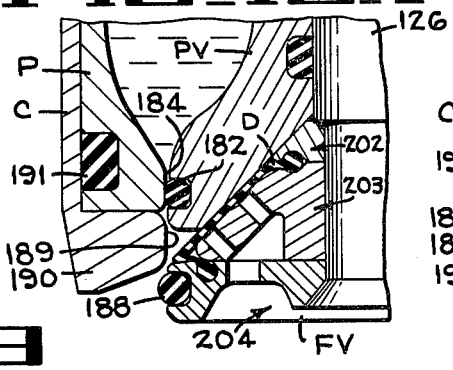
FIG_11A
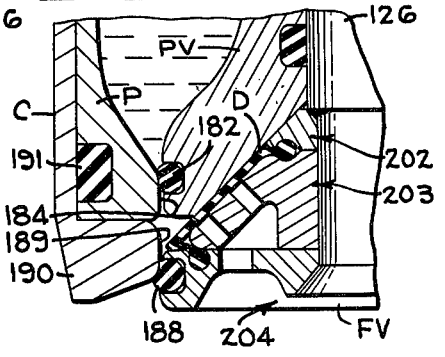

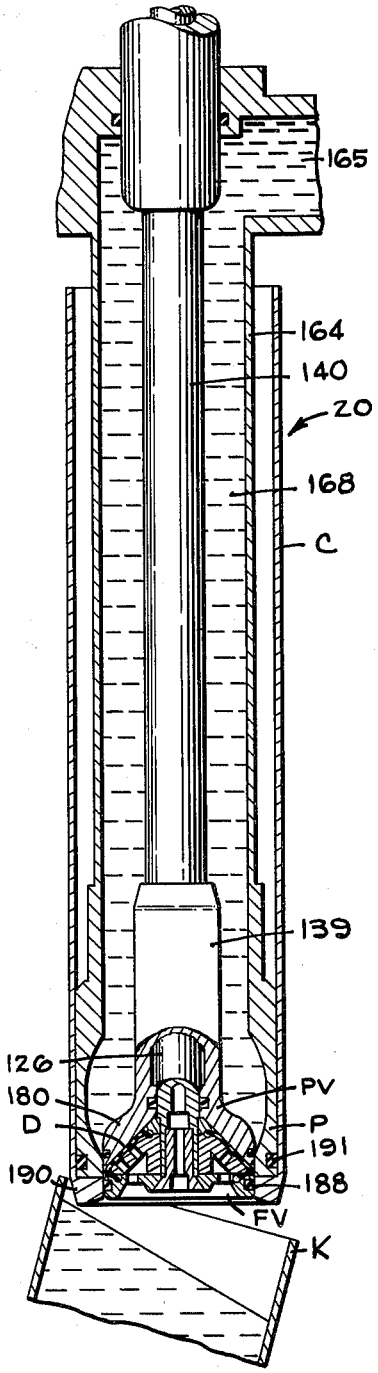
FIG_12
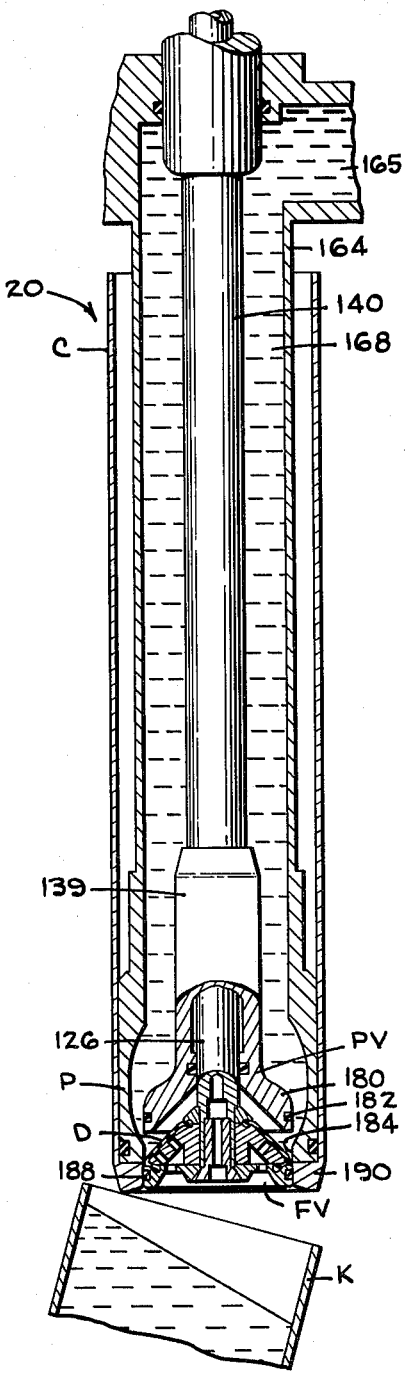
FIG_13
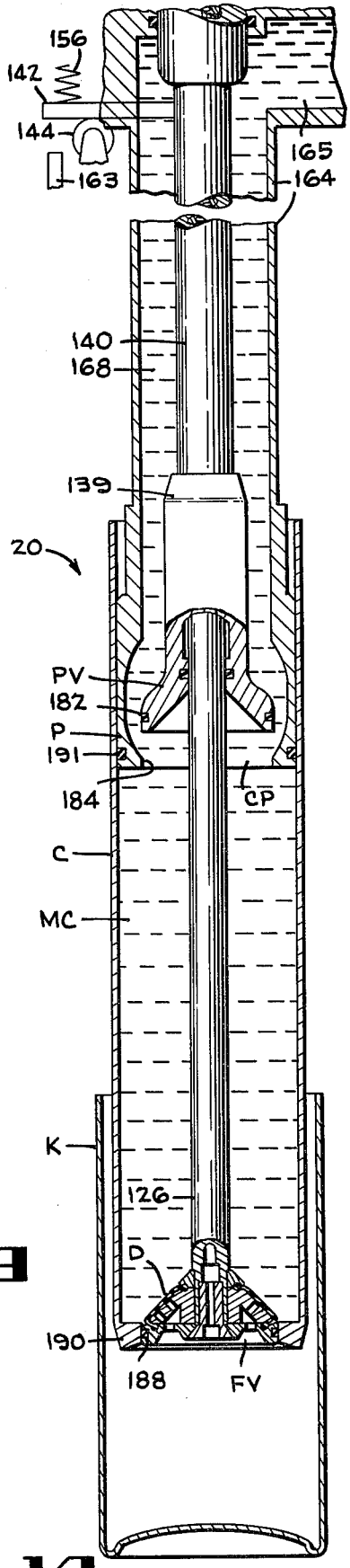
FIG_14
FIG_12A
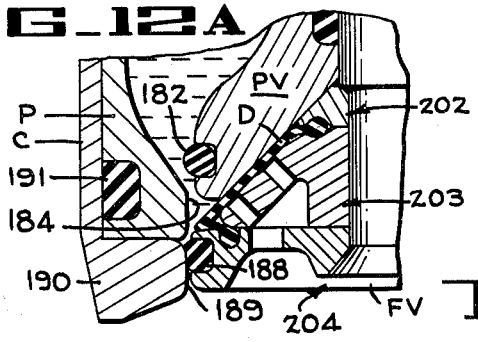

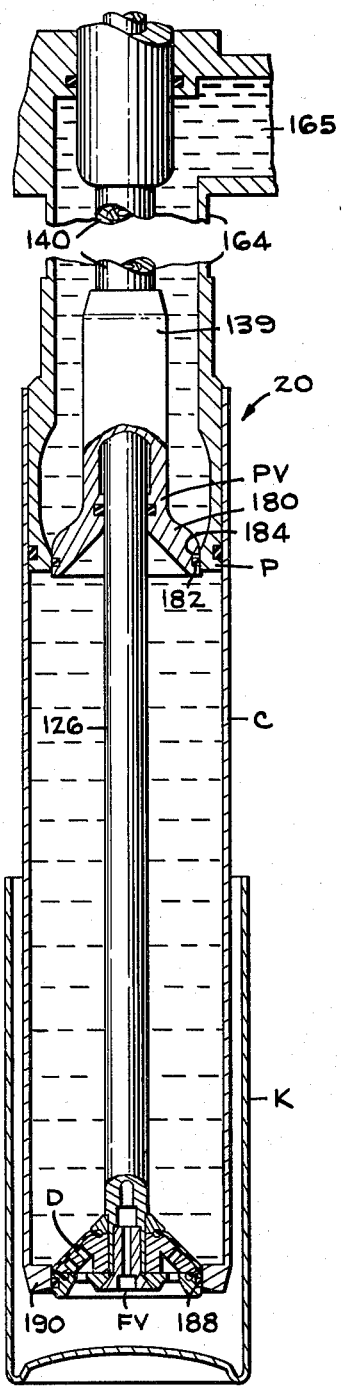
FIG_18
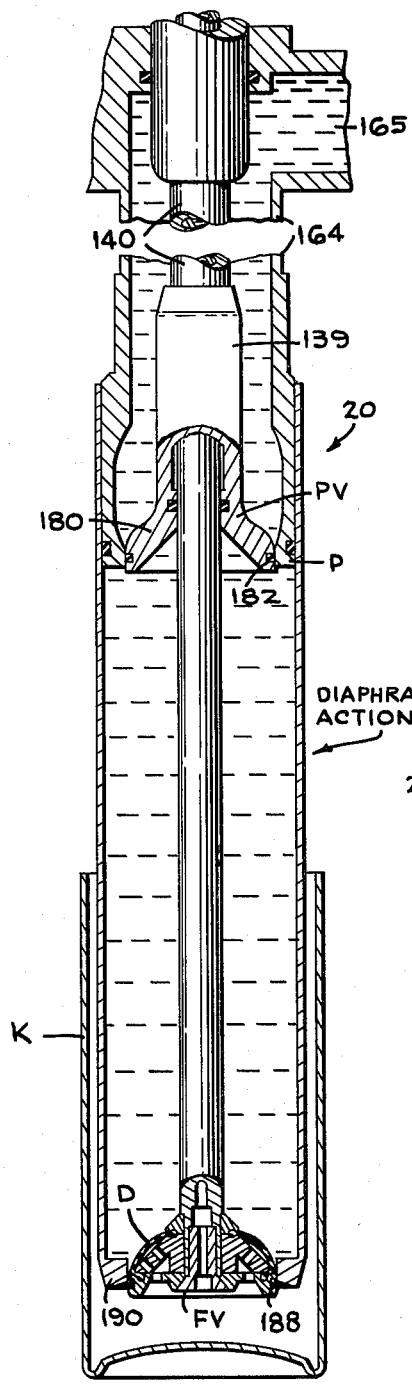
FIG_19
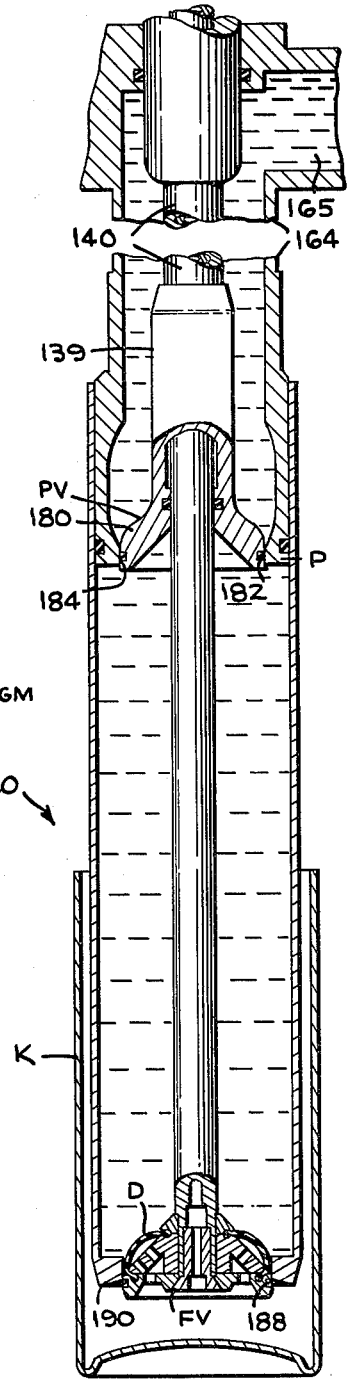
FIG_20
FIG_18A
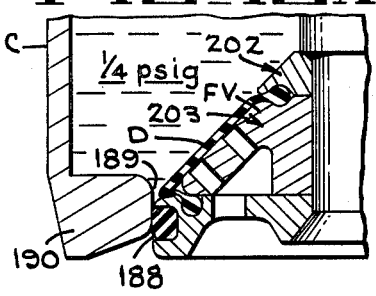
FIG_19A
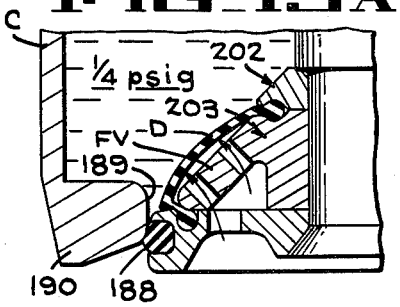
FIG_20A
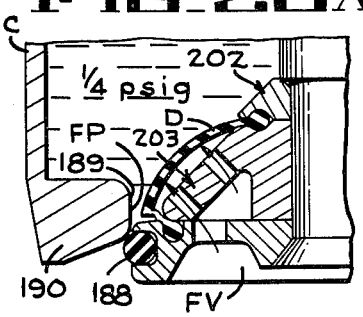

CONTAINER FILLING EMPLOYING ANTI-VACUUM FOOT VALVE

FIELD OF THE INVENTION

This invention relates to fillers, fluent material handling and more particularly to the filling of open top containers with carbonated beverages, such as beer or the like.

DESCRIPTION OF PRIOR ART

The filler of the present invention is an improvement over the filler of the Vadas U.S. Pat. No. 3,949,791, issued Apr. 13, 1976 and assigned to the FMC Corporation. The filler of the Vadas patent is of the rotary type having a circular array of filling valves connected to a liquid reservoir. The valve elements are controlled by cams as the turret and valve elements rotate during the filling process. Each filler valve has four major elements: a cylinder having a filling port, a foot valve for closing and opening the filling port, a piston slidable in the cylinder and having a charging port and a plug valve for opening and closing the charging port. At the end of the charging operation the cylinder and piston are lowered into a container, the plug valve is sealed with the piston and the foot valve is fully lowered to its open position. After the fill, the foot valve is raised from its open position into engagement with the plug valve while the latter is sealed with the charging port in the piston. All gaps, clearances or voids between the two valves now contain air at atmosphere pressure. The operating mechanism continues to raise the foot valve which now bodily lifts the plug valve and a point is reached wherein the foot valve seals off the cylinder filling port while the plug valve is still sealed with the charging port of the piston. Thus the air which is trapped in the gaps, clearances or voids between the two valves remains at atmosphere pressure. The foot valve is raised an additional amount, still lifting the plug valve, until the plug valve breaks its seal with the charging port of the piston but the seal between the foot valve and the cylinder filling port is maintained. Thus, when the plug valve becomes unseated, as just described, the gas which was trapped between the two valves at atmospheric pressure is compressed and displaced by the incoming charging liquid entering the measuring chamber and moves upward.

Another feature of the Vadas U.S. Pat. No. 3,949,791, which is claimed broadly in Mencacci U.S. Pat. No. 3,779,292 issued Dec. 1, 1973, cited in the aforesaid Vadas patent and assigned to the FMC Corporation, is that of enlarging the measuring chamber slightly, after a measured charge has been trapped in the valve, to bring the pressure in the measuring chamber substantially down to atmospheric pressure and to fully seat the plug valve before the foot valve is sufficiently lowered to open the filling port in the cylinder and initiate filling of the container. This lowering of the foot valve can be considered to provide two successive functions or stages. The first lowering stage of the foot valve will be termed a "deblocking" stage. When the plug valve first seals with the cylinder the valve is hydraulically blocked by the gas containing liquid trapped in the measuring chamber, and hence is not lowered to its fully seated position. However, as the foot valve is lowered during the deblocking stage, the plug valve can be said to "follow" the lowering foot valve until the plug valve reaches its fully seated position, as determined by a mechanical stop. At the end of the deblocking lowering stage of the foot valve, the foot valve is still sealed with the filling port of the cylinder. Continuing lowering of the foot valve, while it remains sealed with the cylinder port, further enlarges the measuring chamber and provides a "decompression stage", which accomplishes the aforesaid function of bringing the gas trapped in the measuring chamber substantially down to atmospheric pressure before the foot valve is opened. A continued lowering stage of the foot valve in both the Mencacci and Vadas patents further enlarges the measuring chamber until the foot valve just breaks its seal with the filling port of the cylinder and a final lowering of the foot valve provides a full sized passageway for filling the container with the measured charge trapped in the valve.

SUMMARY OF THE INVENTION

The filler valve of the present invention is provided with a movable pressure equalizing element having an inner surface comprising a part of the inner surface of the measuring chamber and an outer surface communicating with a predetermined absolute pressure (such as atmospheric pressure). It is desired that the pressure in the measuring chamber be equal to the said predetermined pressure just at the time when the foot valve opens for initiating the fill. Under these conditions the liquid will be transferred into the container in the proper manner, such as without foaming, without excessive agitation, or the like. During the opening movement of the foot valve, the pressure equalizing element equalizes the pressure within the measuring chamber and the predetermined absolute pressure, which causes the liquid to be transferred in the aforesaid proper manner.

A specific embodiment of the present invention will be explained with regard to the deblocking, decompression and continued foot valve lowering stages, previously described in connection with the Vadas U.S. Pat. No. 3,949,791. The pressure equalizing element is incorporated in an improved foot valve. The new function of the improved foot valve of the present invention takes place during the aforesaid continued lowering stage of the foot valve, that is, after the foot valve has been lowered sufficiently to complete the decompression stage wherein the gas in the measuring chamber is brought down to atmospheric pressure and up to the condition wherein the foot valve just breaks its seal. The aforesaid deblocking, decompression and continued lowering stages are, in fact, mere initial portions of a continuous lowering action of the foot valve to its fully open position. Because of manufacturing tolerances in the valve parts, their controlling cams and other factors (particularly in a multi-valve filler) it is not possible to adjust the filler so that each foot valve always opens exactly at the end of the decompression stage so that filling will begin at the exact time that gas pressure in the measuring chamber is lowered to atmosphere pressure.

If the foot valve opens too soon, decompression will not have been completed, causing the liquid to squirt out and foam. Accordingly, a tolerance is provided in the foot valve lowering or opening action such that the foot valve is still sealed or closed even after it has been lowered the maximum amount required to decompress the gas in the measuring chamber under maximum tolerance conditions. Thus, the foot valve must be lowered during the continuing stage after the aforesaid decompression stage has been completed and while it is still sealed with the filling port formed in the bottom wall of the cylinder. In the prior fillers, the aforesaid continued lowering of the foot valve at the end of the decompression stage and while the foot valve is still sealed, would draw a vacuum in the measuring chamber. Under these conditions when the foot valve did open, since a vacuum was drawn in the measuring chamber, bubbles of air would be drawn up into the charge in the measuring chamber and cause foaming problems during the ensuing filling step.

In accordance with the preferred embodiment of the present invention, the foot valve is modified to incorporate pressure equalizing structure which maintains the volume of the measuring chamber constant between the termination of the decompression stage and during the continuation stage of lowering the foot valve until it just opens. In other words, the drawing of a vacuum within the measuring chamber, just before the foot valve opens, is prevented.

In the broader aspects of the invention the pressure equalizing function is performed by the provision of a pressure equalizing or anti-vacuum device freely movable in a wall of the measuring chamber while being sealed thereto. Preferably, said device is mounted in said foot valve for holding the volume of the measuring chamber substantially constant as the foot valve is lowered. The pressure equalizing means has an upper face that is exposed to the measuring chamber and a lower face that is exposed to the atmosphere. The pressure equalizing means is held in a retracted position by the pressure of gas trapped in the charge and the weight of the charge in the measuring chamber during an initial stage of foot valve opening movement which brings the pressure within the measuring chamber substantially down to atmospheric pressure while the foot valve is still closed. The pressure equalizing means is projected into the measuring chamber by atmospheric pressure acting on its lower face by a distance sufficient for holding the volume of the measuring chamber substantially constant and thus preventing the drawing of a vacuum in the chamber as the foot valve opening movement continues after pressure of the gas trapped in the measuring chamber liquid has been brought down to atmospheric pressure. This action precludes the drawing up of air bubbles into the charge in the measuring chamber as the foot valve opens and as filling begins and reduces or eliminates foaming that would be caused by such air bubbles, particularly when the filler is dispensing carbonated beverages such as beer or the like.

In the preferred embodiment of the invention the pressure equalizing action is provided by fitting the foot valve with a flexible diaphragm (preferably formed of a rubber-like material) which diaphragm is peripherally sealed to the wall of a foot valve and which is opposed and complementary to a wall of the plug valve. Air ports are formed in the foot valve wall underneath the diaphragm. Thus, until the foot valve is opened, the upper face of the diaphragm is exposed to the forces acting thereon by the charge in the measuring chamber and its lower face is exposed to the atmosphere. So long as the foot valve is sealed, the upper face of the diaphragm is subject to forces caused by the weight of the trapped charge and by the pressure (for example about 25 psig) of gas trapped in the measuring chamber. So long as the gas pressure within the measuring chamber exceeds atmospheric pressure, the diaphragm will be held flat against the foot valve wall. Even at the end of the decompression stage, the weight of the liquid trapped in the measuring chamber provides enough pressure (about $\frac{1}{8}$ – $\frac{1}{4}$ psig) to hold the diaphragm flat. As the foot valve continues to open after the decompression stage the resulting increase in measuring chamber volume which would normally draw a vacuum in the measuring chamber by creating a vapor space at less than atmospheric pressure. However, the diaphragm is sufficiently flexible and distensible that atmospheric pressure, acting on the lower face of the diaphragm through the foot valve air ports, will distend the diaphragm from the underlying foot valve wall into the measuring chamber and prevent the drawing of a vacuum in the measuring chamber during the continued opening stage of the foot valve. Stated differently, the diaphragm can be considered to be distended sufficiently to hold the volume of the measuring chamber substantially constant during continued lowering of the sealed foot valve after the decompression stage. By thus holding the measuring chamber volume substantially constant, with the attendant prevention of drawing a vacuum in the chamber, when the foot valve finally opens sufficiently to dispense liquid to the container, bubbles of air are not drawn up to the measuring chamber charge and hence do not cause foaming problems during filling.

In the preferred embodiment of the invention, the diaphragm is molded to include a thin, flexible hinge portion near its outer mounting edge, which reduces the pressure differential across the diaphragm necessary for causing atmospheric pressure acting on the underside of the diaphragm to distend the diaphragm sufficiently to prevent the drawing of a vacuum, as previously described.

Also, in the preferred embodiment of the invention the diaphragm is formed of an annulus of elastomeric material, such as neoprene rubber or a synthetic rubber capable of withstanding higher temperatures, and is integrally molded to provide the aforesaid reduced thickness flexible hinged portion as well as to form enlarged beads at the inner and outer peripheries of the diaphragm for clamped mounting thereof on the foot valve.

In the preferred construction, the portion of the foot valve element wall which underlies the diaphragm is offset from adjacent surfaces of the wall so that when the diaphragm lies flat on the wall, the upper surface of the foot valve forms a continuous surface for mating with the plug valve.

The present invention also encompasses the method of filling open top containers with a liquid which method includes the known prior steps of trapping a measured charge in a measuring chamber and expanding the chamber to the trapped liquid prior to transferring the liquid in the measuring chamber into a container. The method of the present invention represents an improvement over prior methods comprising the step of maintaining the volume of the measuring chamber substantially constant from the time that liquid decompression is complete until the chamber is opened to transfer the liquid into the container.

BRIEF DESCRIPTION OF THE DRAWINGS

FIGS. 3 and 4 combined illustrate a complete filling valve.

FIGS. 9 - 22 are a series of step-by-step operational views. The angular position of some of the operational views being indicated in the plan view of FIG. 1.

FIG. 9 is taken at 245° of turret rotation wherein the container has been filled and the foot valve is still open.

FIG. 10 is taken at 248.5° wherein the foot valve has been lifted to bring it against the plug valve but the foot valve has not fully closed.

FIG. 10A is an enlarged partial section of the lower left hand portion of FIG. 10.

FIGS. 11 and 11B are taken at 250.5° of rotation showing the foot valve raised to a sealing position with the cylinder and the plug valve still sealing with the piston.

FIG. 11A is an enlarged section similar to FIG. 10A.

FIGS. 12 and 12B are taken at 252° of rotation wherein the foot valve has lifted the plug valve clear of the piston. All valve elements are being lifted simultaneously.

FIG. 12A is an enlarged section like that of FIG. 11A.

FIGS. 13 and 13B are taken at 266° of rotation wherein the plug valve has been lifted independently to clear the foot valve, and all valve elements are still being lifted simultaneously.

FIGS. 14 and 14B are taken at 353° of turret rotation wherein the cylinder and plug valve are being lowered into a previously presented empty container and although the piston and plug valve elements are also being lowered relative to the container they are rising relative to the cylinder and plug valve elements, as indicated by the dashed arrows in FIG. 14, in order to enlarge and charge the measuring chamber of the valve.

FIGS. 15 and 15B are taken at about 15° of turret rotation wherein the cylinder and foot valve have been fully lowered into the empty can, the piston is raised to the charge measuring position and the plug valve has just seated to trap a measured filling charge but is hydraulically blocked from becoming fully seated.

FIGS. 16 and 16B are taken a few degrees of rotation after that of FIG. 15 (about 20°) and shows the foot valve lowered sufficiently for deblocking the plug valve.

FIGS. 17 and 17B are taken at about 26° of turret rotation wherein the foot valve has lowered sufficiently to provide decompression of the gas in the trapped, measured filling charge.

FIGS. 18 and 18B are views like FIGS. 17 and 17B but illustrating a different valve assembly wherein the foot valve had to be lowered further than the foot valve shown in FIG. 17 in order to complete the decompression stage.

FIG. 18A is an enlarged section like that of FIG. 17A, but corresponding to FIG. 18.

FIGS. 19 and 19B are taken a few degrees of turret rotation (about 33°) following FIG. 18 wherein the foot valve has continued its opening movement until the seal is just about cracked and the diaphragm is partially distended.

FIG. 19A is an enlarged partial section like that of FIG. 18A, but corresponding to FIG. 19.

FIGS. 20 and 20B are taken at about 36° of turret rotation wherein the foot valve opening motion has continued sufficiently to just open the foot valve and the diaphragm additionally distended.

FIG. 20A is an enlarged partial section of the foot and plug valves of FIG. 20.

FIG. 21 is a section taken at 40° of rotation showing the piston and cylinder elements being lowered relative to the cylinder to displace the charge in the measuring chamber, the foot valve still being opened.

FIG. 22 is a section taken at 120° rotation showing the foot valve fully open with the cylinder and foot valve being raised relative to the container and with the piston and plug valve being lowered relative to the cylinder to continue dispensing the charge.

GENERAL DESCRIPTION OF THE FILLER

Before describing in detail the improved foot valve element of the present invention, a filling machine embodying the foot valve will first be described. The machine to be described is substantially the same as that of the aforesaid Vadas U.S. Pat. No. 3,949,791, although the valve timing differs slightly.

Figure 1:
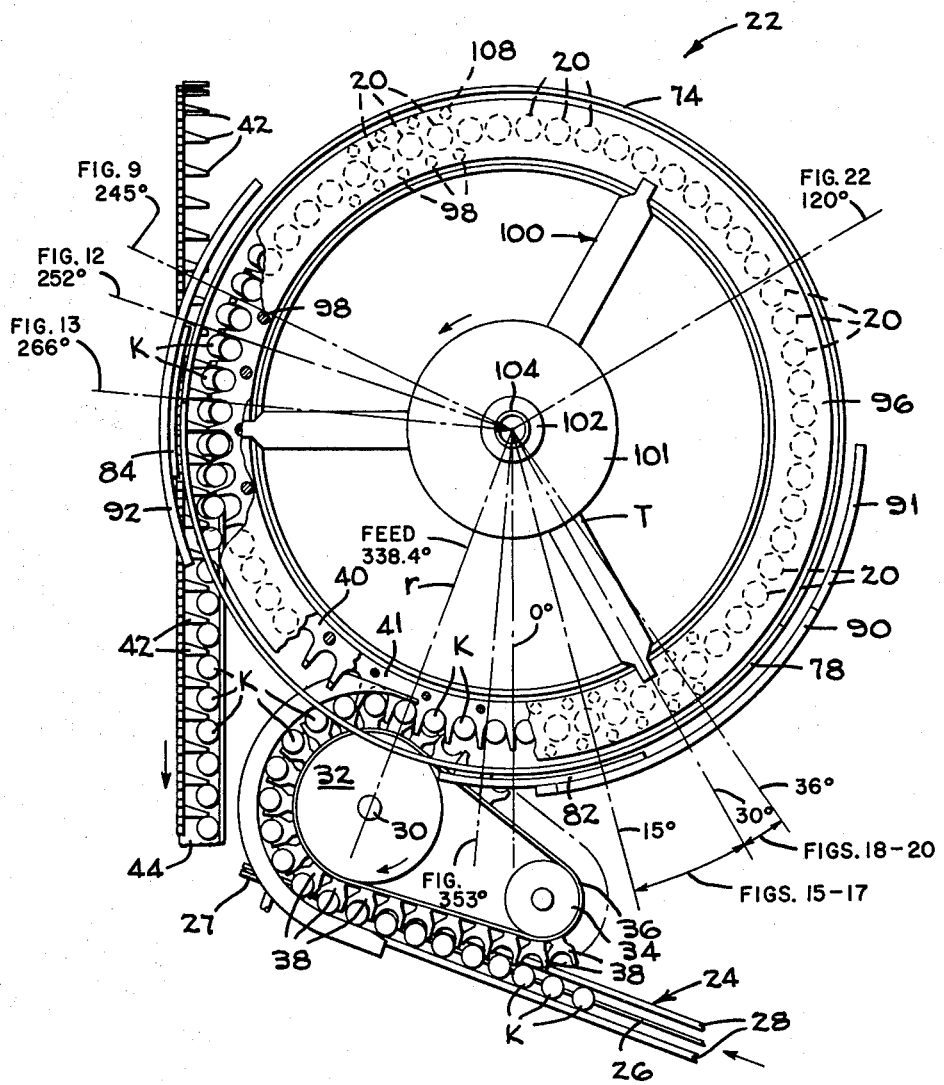
FIG. 1 is a diagramatic plan view, partially broken away, showing a rotary filling machine incorporating the improved filling valves of the present invention.
Figure 2:
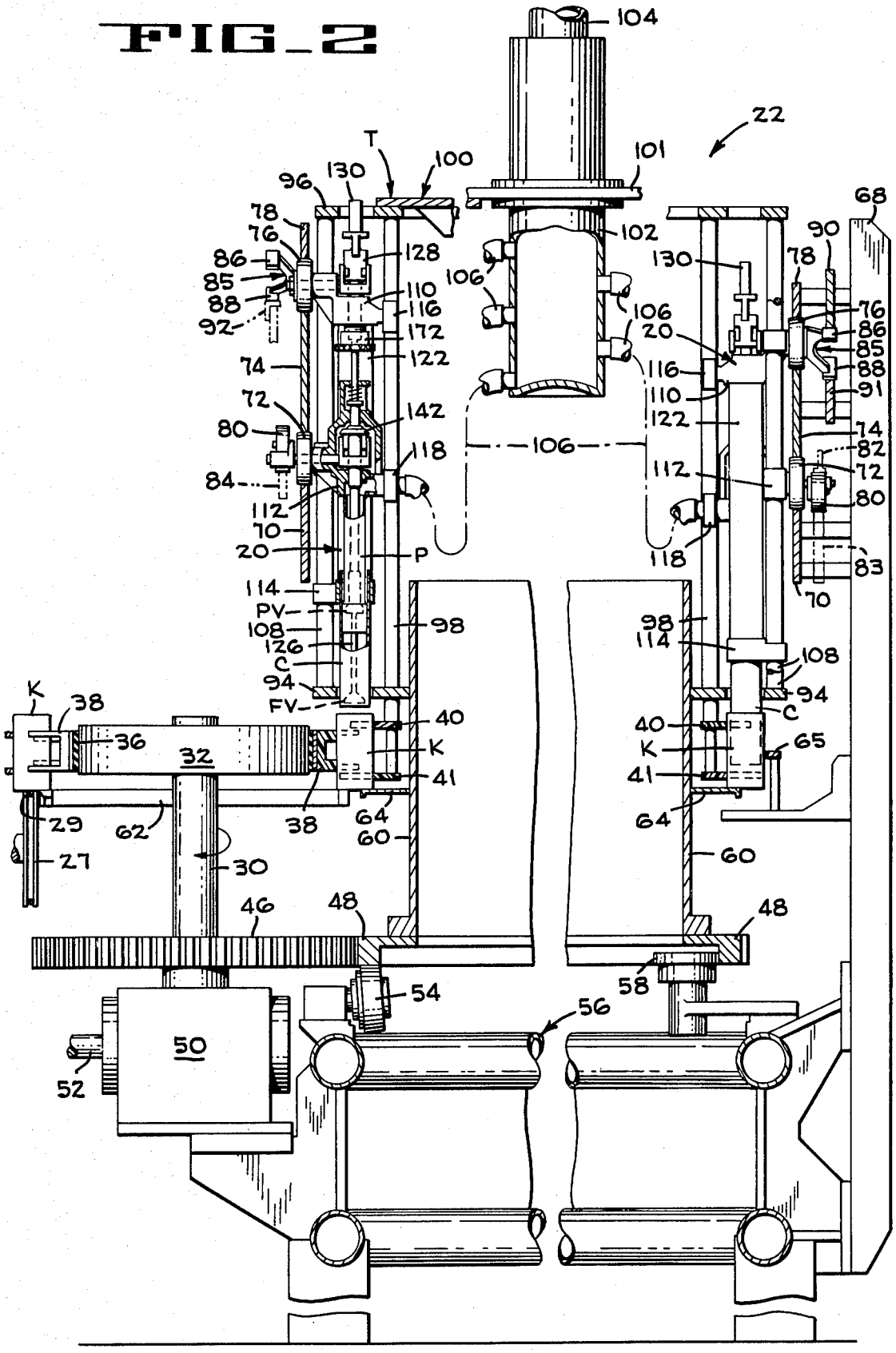
FIG. 2 is a diagramatic vertical section of the filling machine with parts broken away.
Figure 4:
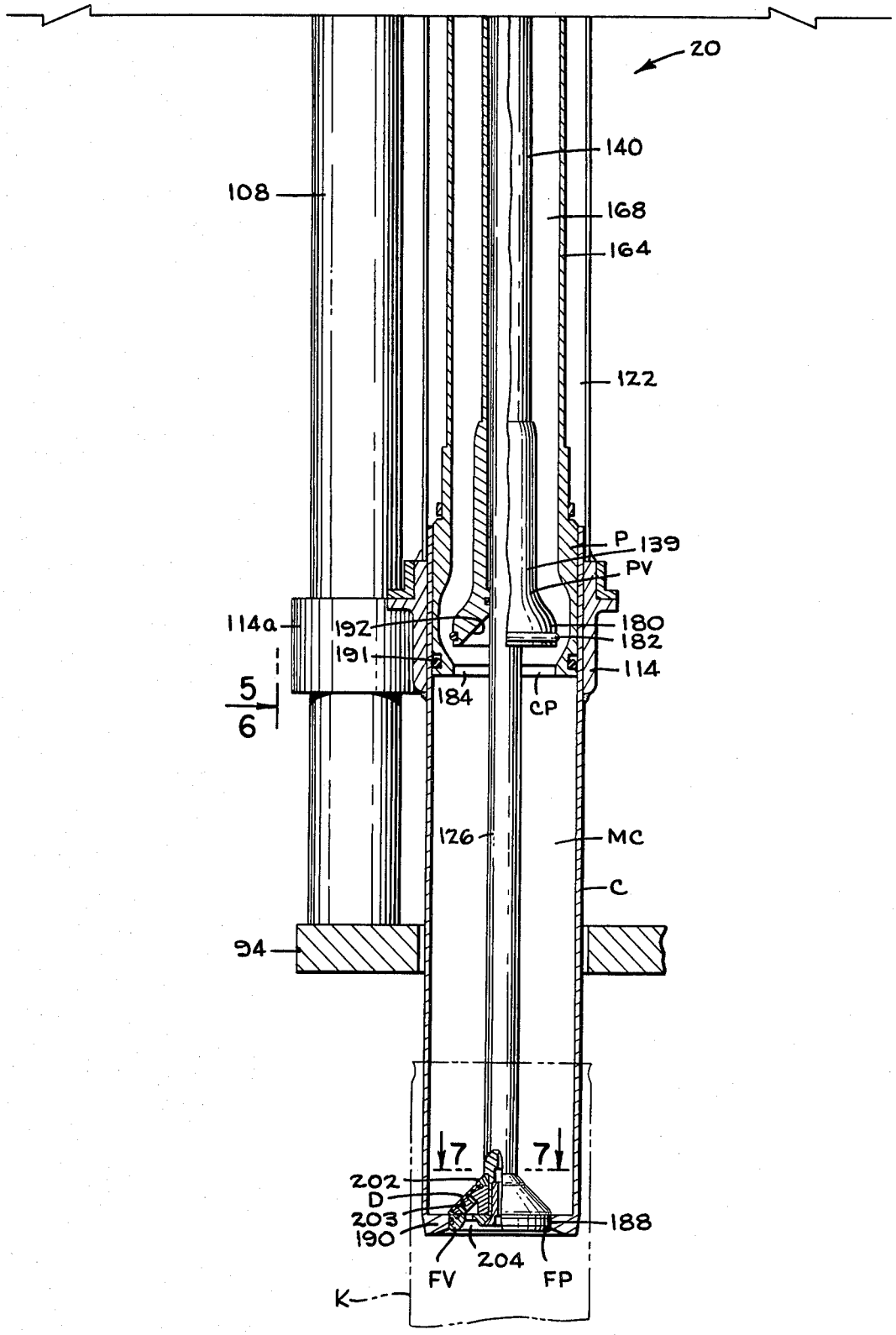
FIG. 4 is an enlarged vertical section of the lower portion of the filling valve shown in FIG. 3.

With reference to FIGS. 1 and 2, the improved filling valves 20 of the present invention are incorporated in a rotary beverage filling machine 22 for filling carbonated beverage to open top containers K. As seen in FIG. 4, each filling valve 20 includes a vertically movable cylinder C that telescopes within the containers, a foot valve FV that closes off a filler port in the cylinder, a combined measuring and displacer piston P slidable in the cylinder C, and a plug valve PV that closes off a charging port in the piston P. At times certain valve parts are raised and lowered together, at other times they are raised and lowered independently.

Referring back to FIG. 1, the containers are supplied to the filling machine 22 by a feed mechanism 24, of known construction, which includes an endless driven container support cable 26 driven by a pulley 27 and flanked by guide rails 28. In order to synchronize the incoming containers (e.g. cans) with the filler pockets, a power input shaft 30 drives a circular drum 32 which, in conjunction with an idler drum 34, support an endless flexible belt 36. Mounted on the belt 36 are precisely spaced, open faced container grippers 38 that pick up and carry the incoming cans K along an arcuate path which becomes tangent with the circular path of the filling valves 20. As the cans appraoch that point of tangency, they are individually received within pockets formed in upper and lower can drive plates 40,41 (see FIG. 2) that advance counterclockwise as viewed in FIG. 1 and which are part of a driven rotary turret T.

Arbitrarily dividing the circumference of the turret into degress, 0° is shown at bottom dead center in FIG. 1, which is about 21.6° to the right of a radius "*r*" passing through the center of the filler and the center of the feed wheel 32, at which position a can K is fully transferred to a turret pocket at 338.4° of turret rotation. Each can is received in a filler pocket that is aligned with a filling valve. Container filling begins at about 40° of turret rotation and continues on through 0° and around up to 245° (FIG. 9), at which time the fill is complete and the valve has almost been lifted clear of the filled can. Lifting of the filling valve 20 continues until it completely clears the container at about 266° (FIG. 13). The turret is now positioning the filled can between adjacent pusher fingers 42, on a discharge conveyor 44, which pick up the cans from the turret pockets and slide the cans along the discharge conveyor 44 for transfer to a capping or lidding machine, not shown.

The driving structure is shown in FIG. 2. The vertical drive shaft 30 carries a turret drive gear 46 which is meshed with a large diameter ring gear 48 on the bottom of the turret T. The vertical shaft 30 is powered by a gear box 50 that is driven by a power input shaft 52 from a power source, not shown. The large ring gear 48 directly supports all of the rotatable components of the turret T, and in turn is supported by a plurality of rollers 54 (only one of which is shown) which are mounted atop a fabricated, floorsupported frame structure 56. The rotating ring gear 48 is centered about the turret axis by a plurality of rollers 58 that are mounted on the support 56 and roll about vertical axes against an inner surface of the ring gear 48. Concentrically mounted on top of the ring gear 48 is a rotatable cylindrical frame 60, which mounts the remaining turret components.

Incoming cans K are transferred from the driven cable 26 onto a semicircular table 62 (FIG. 2) which has an upper surface coplanar with an annular flange 64 on the rotatable frame 60. Thus, once the containers are transferred onto the turret T, the container supporting flange 64 and a cooperating lateral guide bar 65 (at the right side of FIG. 2) plus the pocketed drive plates 40 and 41, support, guide and propel the containers about the rotational axis of the turret T. In the form shown, the turret is provided with 60 pockets and can be rotated at 25 RPM, in which case the filler will fill 1500 cans/minute.

VALVE OPERATORS

As thus far described, the filling machine 22 is of known construction and general operating principles; the present invention particularly concerns an improvement in the filling valves 20 by means of which no vacuum is drawn when the foot valve is opened for filling. Before describing the details and operation of this improvement, a general description of the valves and their operating mechanism will be presented.

A plurality of fixed vertical uprights 68, one of which appears at the right of FIG. 2, project upwardly from the support 56 and extend around the turret T for supporting a plurality of adjustably mounted cam tracks, which actuate various elements of the filling valves 20. A lower and radially innermost piston cam 70 is below a piston actuating roller 72. The piston roller 72 engages the lower edge **74*p* of a continuous cylinder and piston control cam 74**.

During filling, the lower edge **74*p* of the cam 74 lowers the piston relative to the cylinder to decrease the volume of the measuring chamber and expel the measured charge into a container such as the can K. Riding on the upper edge 74*c* of the cylinder and piston control cam 74 is a cylinder actuating roller 76. A cam 78 is above and slightly spaced from the cylinder roller 76 to prevent the cylinder roller 76** from rising under certain operating conditions.

Radially outward of the cams 70,74 (FIGS. 2, 3 and 5), each filling valve is provided with a plug valve operating roller 80 which during part of its travel around the turret T travels under a plug valve closing (lowering) cam 82 (FIGS. 1 and 2) that straddles the 0° rotational position as shown in FIG. 1, appears in phantom at the right of FIG. 2. Below the cam 82 is a cam 83 (FIG. 2) which prevents unwarranted overtravel of the plug valve but does not control it during filling. In another portion of its circumferential travel, the plug valve roller 80 (see the left side of FIG. 2) rides over a plug valve opening (lifting) cam 84, which opens the plug valve PV independently of the motion of the piston P for admitting charging liquid to a measuring chamber MC (FIG. 4) defined by the cylinder and foot valve and by the piston and plug valve.

During certain portions of a cycle the foot valve FV is independently opened and closed by a cammed, rotatably mounted actuator 85 (FIGS. 2, 3 and 5) having laterally projecting, upper and lower camming shoes 86 and 88. The upper shoe 86 is actuated by a foot valve opening cam 90 cooperating with a lower, parallel cam 91 (FIGS. 1 and 2) during the container filling part of the cycle. During other parts of the cycle, the foot valve is closed by the lower shoe 88 on the actuator 85 and a foot valve closing cam 92 (FIGS. 1 and 2).

VALVE MOUNTING AND CONNECTIONS

The structure for supporting the filling valves 20 (FIG. 2) of the present invention includes a lower ring 94 which is secured to the rotatable frame 60, and an upper ring 96 which is partially supported by the lower ring by a radially inner circumferential series of vertical guide rods 98, secured to the lower ring 94 adjacent their lower ends. These rods prevent twisting of the valves about their vertical axes. Lower extensions of the rods 98 support the pocketed rings 40,41. As seen in FIG. 1, each rod 98 is disposed in radial alignment with the gap between each two adjacent valves 20.

As shown in FIGS. 1 and 2, the upper ring 96 supports a three spoked spider 100 having a hub 101. Centrally connected to the spider hub and coaxial with the turning axis of the turret T is a rotatable manifold tank 102 connected to a fixed supply line 104 (FIG. 2) through a rotary coupling joint (not shown). The supply line 104 delivers a carbonated beverage into the manifold tank 102, usually at superatmospheric pressure, and the beverage is fed to the valves 20 by individual flexible supply lines 106.

Also interconnecting the upper and lower rings 96, 94 of the turret T, are a plurality of radially outer, vertical tie rods 108 which slidably guide and radially locate the filling valves. As shown in FIG. 2, the cylinder C of each filling valve 20 is mounted in vertically spaced upper and lower brackets 110 and 114 which have apertured sleeves 110a,114a (FIG. 5) slidable along an associated tie rod 108. The upper cylinder brackets 110 are provided with inwardly directed guide blocks 116 (FIGS. 2 and 3) that are slidably guided between adjacent guide rods 98. Each piston P is supported on a bracket 112 which has an outer sleeve 112a (FIG. 3) that slides on a tie rod 108 and a guide block 118 that slides between adjacent guide rods 98. Thus the cylinder C and the piston P are mounted for non-rotary, vertical sliding movement in the rotatable turret T.

VALVE RAISING AND LOWERING

Figure 3:
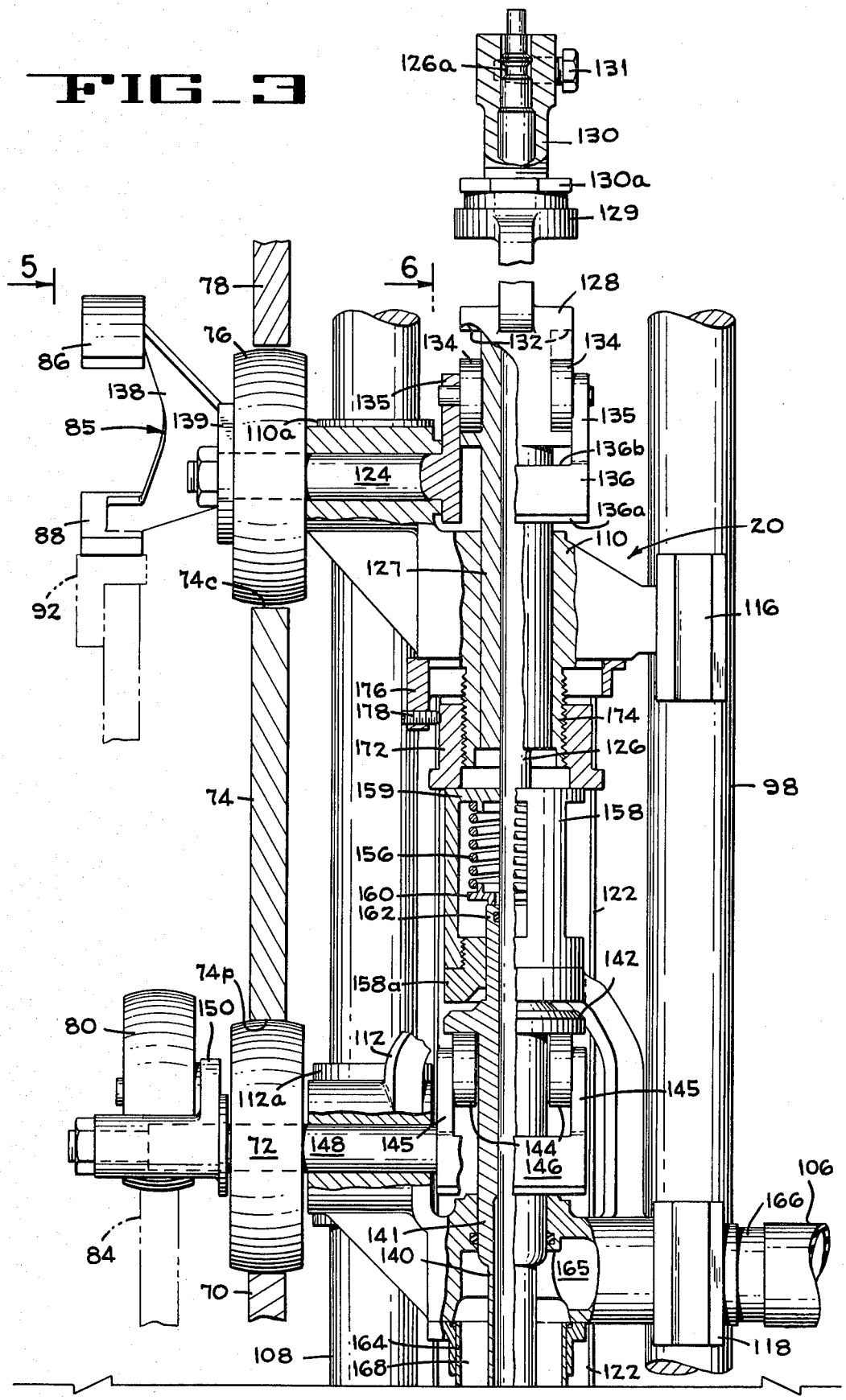
FIG. 3 is an enlarged vertical section of the upper portion of a filling valve.

Although the internal components of the filling valve 20 are vertically movable relative to one another (plug valve PV relative to the measuring piston P, and foot valve FV relative to the cylinder C) the entire filling valve 20 is raised, for removal from and telescoping into, a can K, by means of the cylinder actuating roller 76 and the upper edge 74c of the cylinder control cam 74, (FIG. 3). The cylinder is lowered under control of the cam 74, except for a short period in the cycle when the cylinder is supported by the piston roller 72 and the cam 70 through a measuring chamber adjustment assembly, to be described.

Figure 5:
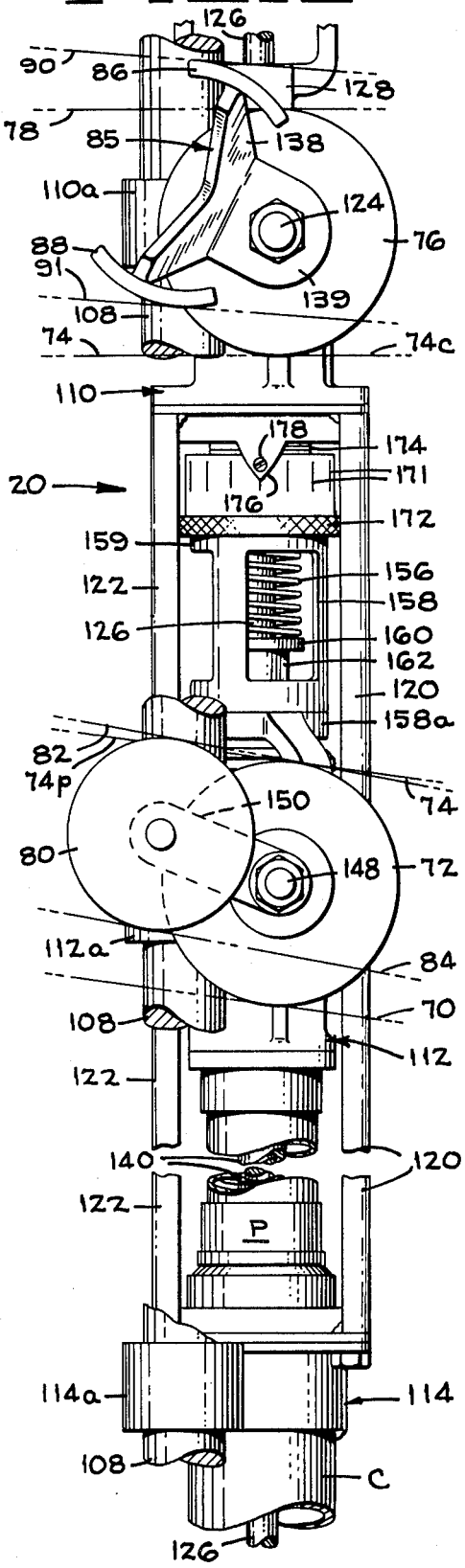
FIG. 5 is an elevation, partly broken away, on a slightly reduced scale, indicated by lines 5 — 5 on FIGS. 3 and 4.
Figure 6:
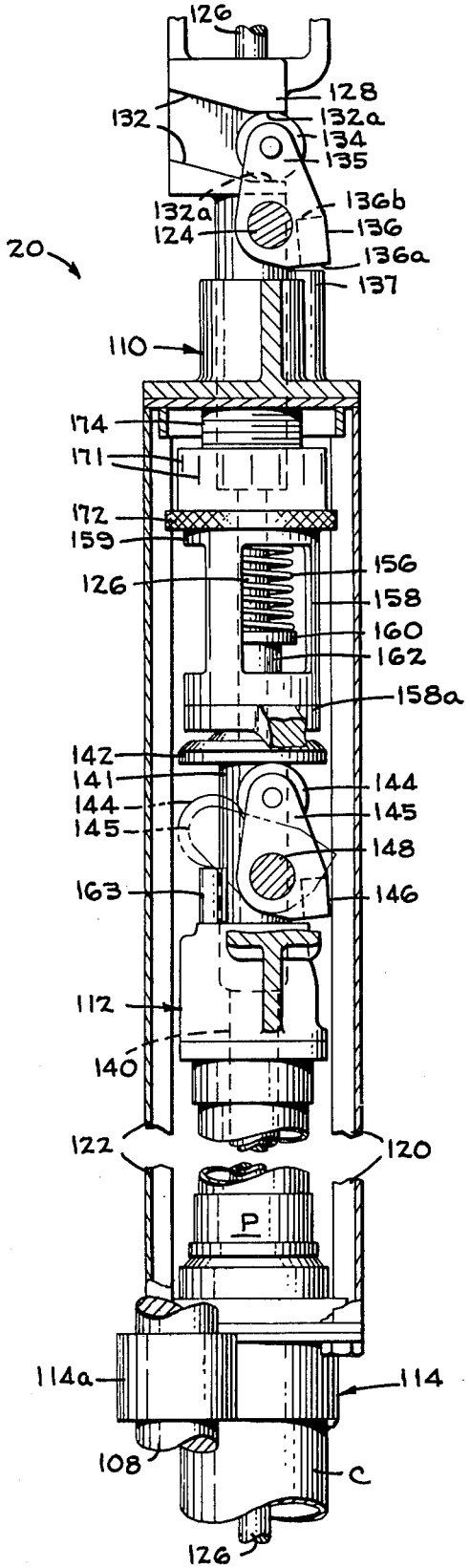
FIG. 6 is a diagramatic section, at slightly reduced scale, indicated by lines 6 — 6 on FIGS. 3 and 4.

As best seen in FIGS. 5 and 6, the upper cylinder bracket 110 is connected to the lower cylinder bracket 114 by laterally spaced channels 120,122 which respectively lead and trail the valve as the valve travels about the axis of the turret T. As seen in FIG. 3, the cylinder roller 76 is mounted on a stub shaft 124 which can oscillate within the upper cylinder bracket 110. Thus, as the roller 76 rides along and is supported by the edge 74c of the cam 74, the vertical position of the cylinder depends upon the cam contour. The complete cam layout is not shown because the precise dimensional layout details of actual cams represent routine engineering.

THE FOOT VALVE FV

As seen in FIGS. 2 and 4, the foot valve FV is mounted on the lower end of an actuating rod or valve stem 126 which extends upward through the cylinder C, the piston P, and the plug valve PV (FIG. 4). The rod 126 also extends through a sleeve 127 of a cam track block 128 (FIG. 3). Rigid with the cam track block 128 is a yoke 129, into the upper end of which is threaded a quick connector coupling 130 that is axially locked by a lock nut 130a. The foot valve actuating rod 126 is provided with a necked-down portion 126a, one sector of which is engaged by the frustoconical head of a locking bolt 131 that is threaded into the quick connector coupling. By axially adjusting the quick connector coupling 130 relative to the yoke 129, the foot valve FV (FIG. 4) can be elevationally adjusted, and by removing the locking bolt 131, the foot valve FV and the actuating rod 126 can be withdrawn downwardly for cleaning or replacement.

Returning to the cam track block 128, the latter is formed with inclined grooves on opposite sides of the block (FIGS. 3 and 6) to provide inclined opposed cam tracks 132 (FIG. 6), for opening and closing the foot valve FV while the cylinder C remains substantially stationary. The cam tracks 132 receive rollers 134 mounted on the upper ends of crank arms 135, which arms are connected by a cross bar 136 having a lower surface 136a which contacts a fixed abutment 137 when the crank arms are in their over-center position. As seen in FIG. 3, the shaft 124 carrying the cylinder roller 76 is connected to the crank arms 135 and the cross bar 136.

The foot valve actuator 85 has a wing member 138 for mounting the cam shoes 86, 88 and a hub 139 that is keyed on the outer end portion of the cylinder roller mounting shaft 124. When the cam shoe 86 is moved down (counterclockwise rotation of shaft 124) by the foot valve opening cam 90 the rollers 134 (FIG. 6) lowers the foot valve. When the cam shoe 88 is raised by the foot valve closing cam 92, the shaft 124 turns clockwise and the rollers 134 move along the cam tracks 132 to raise the foot valve actuating rod 126 for closing the foot valve FV.

As seen in FIG. 6, the cam tracks 132 have short horizontal portions or flats 132a and these receive the rollers 134 when the cranks 135 have been turned clockwise sufficiently to raise the foot valve FV to its closed position. A slight additional clockwise rotation of the cranks 135 by the cam 92 and shoe 88 (FIG. 5) rotates the cranks so that the centers of rollers 134 are moved overcenter relative to a vertical plane through the center of shaft 124. The crank stop 136 (FIG. 6) now engages the stop 137 on the cylinder bracket 110.

During turret rotation, at about 15° the upper foot valve cam shoe 86 strikes the downwardly inclined foot valve opening cam 90 (FIG. 5), and then rides under the cam in sliding contact therewith. Thus, the upper shoe 86 is progressively lowered to turn the shaft 124 clockwise. The resulting counterclockwise swing of the crank arms 135 unlocks the foot valve and moves the rollers 134 along cam surfaces 132 (FIG. 6) about the axis of the shaft 124, which lowers the cam track block 128. Since the anchor block 130 for the foot valve rod 126 is integrally attached to the cam track block 128, the aforesaid crank arm rotation will also lower the foot valve FV (FIG. 4) to its open position. During said rotation, the camming shoe 88 may contact the associated lower cam 91 (see FIG. 1), to control the rate of opening of the foot valve FV. When the foot valve FV is fully opened by turning the shaft 124 counterclockwise as just described, a surface 136b (FIG. 6) of the cross bar 136 contacts the cam block 128 to limit the opening motion of the foot valve.

Later in the operating cycle, at about 240°, the lower cam shoe 88 reaches and rides up along the upwardly inclined foot valve closing cam 92, (see FIGS. 1 and 3). It can be seen from FIGS. 5 and 6 that the lower shoe 88 is thus raised, and hence the crank arms 135 will be turned clockwise. The resulting force applied to the cam track block 128 (FIG. 6) lifts the foot valve actuating rod 126 to close the foot valve, which closing is completed when the roller 134 rides over center and is positioned on the flats 132a.

THE PLUG VALVE PV

The plug valve PV (FIG. 4) is cammed open against the force of a spring 156 (FIG. 3), which spring closes the plug valve under upper and lower cam control of the cam roller 80 until the plug valve closing motion is ended by a positive stop. This positively seals off the charging port CP at the bottom of the measuring piston P after the piston has been raised to its measured charge position. As seen in FIG. 4, the plug valve PV has an integral, smoothly contoured hollow shank 139 which surrounds the actuating rod 126 for the foot valve FV. The shank 139 has a tubular extension 140 that clears the rod 126 and which terminates in a thick walled upper end portion 141 (FIG. 3) forming a sleeve that is slidable on the foot valve actuating rod 126. The sleeve 141 has an integral circular plug valve opening flange 142, which flange is supported by spaced rollers 144 except during a short period of initial plug valve closing when a hydraulic block occurs between the plug valve PV and the foot valve FV.

The rollers 144 for actuating the plug valve PV are mounted on crank arms 145 connected by a cross bar 146, in the manner of the previously described crank arms 135 which operates the foot valve FV. Integral with crank arms 145 and cross bar 146 is a shaft 148 (FIG. 3) which extends through the piston bracket 112. The shaft 148 not only mounts the piston roller 72, but also has secured thereto a trailing crank arm 150, best shown in FIG. 5, which mounts the plug valve roller 80 (FIGS. 3 and 5). The plug valve flange 142 is urged downwardly by the compression spring 156 for closing the plug valve. The spring 156 is confined within a tubular spring cage 158 which is threaded on a collar 158*a* (FIG. 3) formed on the upper portion of the cylinder bracket 112.

The plug valve closing spring 156 is compressed between the upper wall 159 of the spring cage 158 and a spring socket washer 160 which is supported by an upward extension 162 of the plug valve guide sleeve 141 that is integral with the plug valve lifting flange 142. When the plug valve roller 80 is raised by the plug valve opening cam 84 to the position shown in FIG. 5, this moves the crank arms 145, (FIG. 6) clockwise sufficiently to move the axes of the rollers 144 a few degrees overcenter from the axis of the shaft 148, and the plug valve PV is thus locked in its open position until the crank arms 145 are cammed to a position which permits the plug valve to be closed by the plug valve closing spring 156. Even though the crank arms 145 and rollers 144 are cammed to permit the plug valve to close, the plug valve PV (FIG. 4) is fully closed or seated in the piston P only after the hydraulic block by the liquid in the filled measuring chamber MC has been removed. When the plug valve is fully seated, the flange 142 is supported by the rollers 144 after the cam 82 has brought the rollers 144 to the phantom line position of FIG. 6. In this position, further downward motion of the rollers 144 is prevented by an upwardly projecting stop lug 163 on the piston bracket 112. As mentioned, the initial seal of the plug valve PV with the piston P creates the aforementioned hydraulic block which temporarily prevents the plug valve from becoming fully seated. Under these conditions, although the rollers 144 may have been left free by cams 82, 83 to rest against the stop 163, the aforesaid hydraulic block of the plug valve prevents the plug valve flange 142 from reaching its lowermost position and there will be a gap between the flange 142 and the rollers 144. When the hydraulic block of the plug valve is removed, the flange 142 will engage the rollers 144 under the force of the spring 156 and the gas pressure in the carbonated beverage above the plug valve, whereupon the plug valve PV is fully seated.

MEASURING PISTON

The tubular measuring piston P (FIG. 4) has a lower enlarged section that slidably fits the cylinder C and has a smaller diameter, upwardly projecting tubular extension 164, the upper end of which (FIG. 3) is rigidly secured to the lower end of the measuring piston bracket 112. As mentioned, the piston bracket 112 pivotally mounts the piston roller 72. The upper end portion of the measuring piston extension 164 merges with an inlet passage 165 that is formed in the piston bracket 112 and leads through the guide block 118 to an inlet nipple 166 that is connected to one of the supply hoses 106. Thus, a liquid charging passage 168 is formed between the plug valve PV and the interior surface of the measuring piston P, which passage is continuously supplied with the carbonated beverage from the manifold tank 102 (FIG. 2). When the piston bracket 112 (FIG. 3) is raised by gas pressure in the liquid below it, and when the piston is lowered by the lower cylinder cam surface 74*p*, the measuring piston P is moved vertically within the cylinder C. Also, unless the plug valve crank arms 145 are independently operated by the roller 80 and cams 82, 83 (FIG. 5) to close the plug valve, the plug valve PV is raised and lowered in synchronism with the measuring piston P.

As thus far described, it is seen that the upper cylinder bracket 110 (FIG. 3) supports the cylinder C and the foot valve FV for movement of the cylinder C (FIG. 4) into and out of the containers K to be filled. However, as previously described, the foot valve can be independently opened and closed relative to the cylinder, by the crank arms 136, etc. (FIG. 6). The piston bracket 112 (FIG. 3) is connected to the piston P and may support the plug valve PV for simultaneous vertical motion of the piston and plug valve relative to the cylinder, although the plug valve PV can be independently opened and closed relative to the piston during portions of the cycle.

EFFECTS OF BASIC CYLINDER AND PISTON MOTIONS

Referring to FIG. 3 the cylinder and piston control cam 74 provides two basic motions to the cylinder C and the piston P. One of these basic motions can be considered as being relative to the frame of the filler. Thus, when the upper surface 74*c* of the cam 74 rises, the cylinder rises and vice versa. Similarly, when the lower surface 74*p* rises, the piston rises and vice versa.

The other basic motion is motion of the piston relative to the cylinder. Regardless of whether the surfaces 74*c* and 74*p* of the cam 74 are rising or falling, when these surfaces diverge or spread apart, the lower piston roller 72 is moved away from the upper cylinder roller 76 and this causes the piston to be lowered relative to the cylinder.

This apparently reversed action occurs because although the lower end of the piston above the lower end of the cylinder, the piston roller 72 is below the cylinder roller 76. Thus, when the rollers are spread apart the piston is lowered relative to the cylinder. This action collapses the measuring chamber MC and occurs when the plug valve has closed off the piston port and the foot valve has opened the cylinder port. The resultant collapse of the measuring chamber provides the container filling portion of the cycle.

When the cam surfaces 74*c* and 74*p* of the cam 74 converge or come together the piston roller 72 is moved toward the cylinder roller 76 and due to the aforesaid "reversed" relation of the rollers, this causes the piston to be raised relative to the cylinder. This action expands or enlarges the measuring chamber and occurs when the plug valve has opened the piston port and the foot valve has closed the cylinder port. The resultant enlargement of the measuring chamber occurs during the measuring chamber fill or charging portion of the cycle. The piston is fully raised relative to the cylinder to establish the selected volume of the measuring chamber at about 10° of turret rotation.

If the cam surfaces 74c and 74p become parallel in the sense that the vertical separation of the rollers 72,76 remains constant, even though both cam surfaces may be rising, or falling, there is no relative motion between the piston and the cylinder.

VOLUME ADJUSTMENT

In order to provide a fine adjustment of the volumetric capacity of the measuring chamber MC (FIG. 4), the maximum vertical separation of the cylinder C from the measuring piston P is adjustable to define the selected volume of the measuring chamber MC. For this purpose, the upper end wall 159 (FIG. 3) of the spring cage 158 (which are both part of the piston bracket 112) is arranged to contact an internally threaded adjusting nut 172 which is threaded onto an externally threaded stem 174 that is a part of and depends from the cylinder bracket 110. A depending pointer bar 176 (FIG. 5) on the cylinder bracket 110 carries a set screw 178 which is arranged to contact the adjusting nut 172 and lock it in place. The exterior surface of the adjusting nut is provided with indicia 171 (FIGS. 5 and 6) which are read against the pointed lower end of the pointer bar 176 (FIG. 3) so that the volumetric capacity of the measuring chamber can be predetermined and set by scale.

SEALS

Referring back to FIG. 4, the plug valve PV has a cylindrical lower end 180 which is circumferentially grooved to mount an O-ring 182. The measuring piston P has a cylindrical seating surface 184 with which the plug valve O-ring 182 effects a fluid tight seal when the plug valve is closed to trap a measured charge in the measuring chamber MC. When the plug valve is open, a charging port CP is provided between the plug valve PV and the lower end of the measuring piston P, through which the carbonated beverage is supplied by the reservoir to the measuring chamber MC.

The lower end of the foot valve FV is grooved for an O-ring 188 (FIG. 8) which cooperates with a cylindrical sealing surface 189 in the bottom wall 190 of the cylinder C. To effect a sliding seal between measuring piston P and the cylinder C, the piston P carries an external sealing O-ring 191 (FIG. 4).

The plug valve PV (FIG. 4) is provided with a conical recess 192 in its undersurface which is complementary to a conical upper surface formed on the foot valve FV by a resilient diaphragm D and other foot valve parts to be described.

DIAPHRAGM TYPE FOOT VALVE

Figure 7:
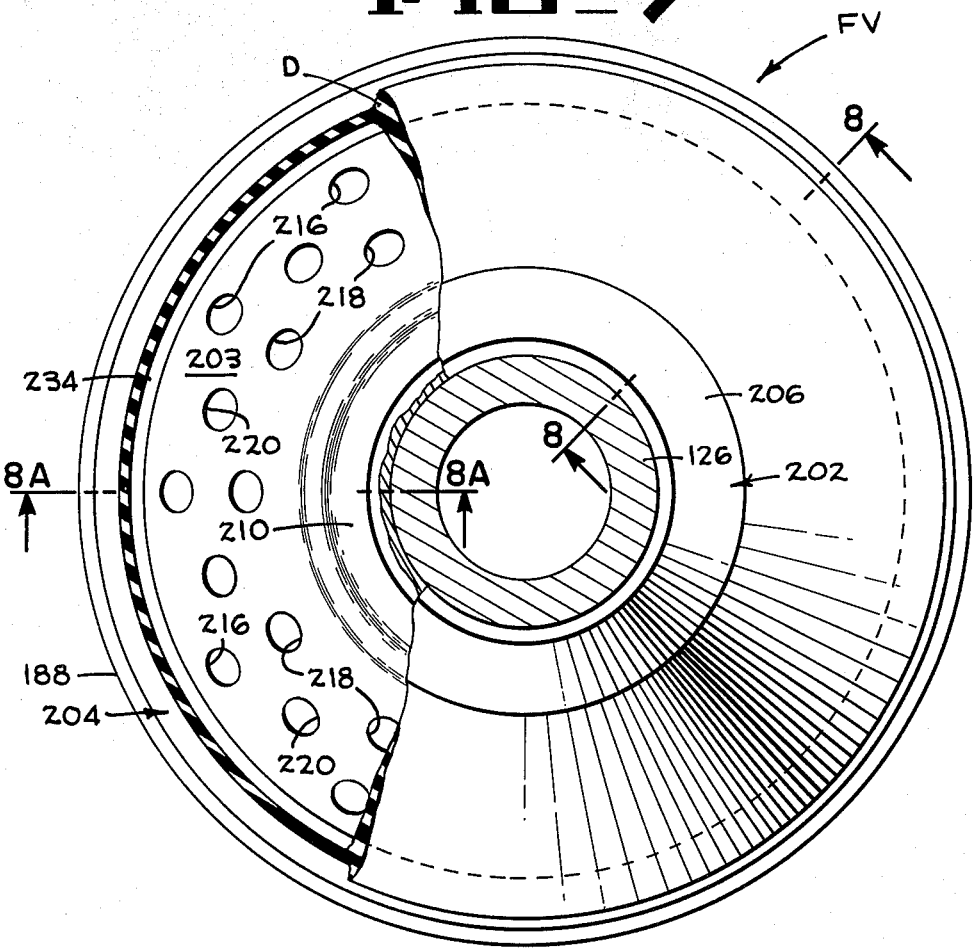
FIG. 7 is a plan view of the diaphragm foot valve illustrated by a section taken on 7 — 7 of FIG. 4, and with a portion of the pressure equalizing diaphragm broken away.
Figure 8A:
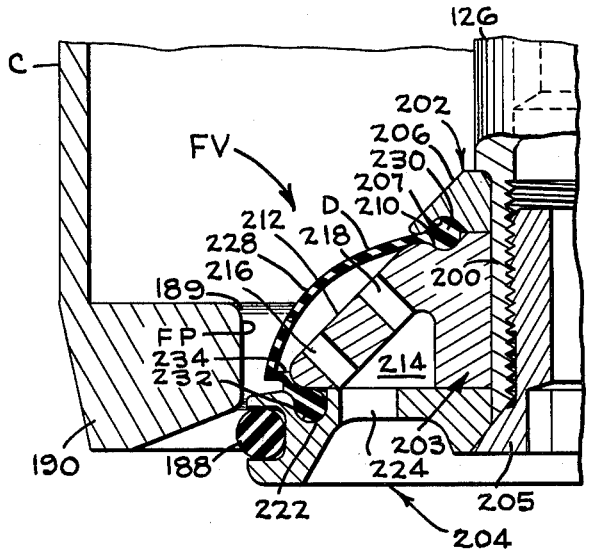
FIG. 8A is a section taken as indicated at 8A — 8A of FIG. 7 but with the diaphragm distended. Both FIGS. 8 and 8A also include a portion of the cylinder with its bottom wall and cylindrical seating surface.
Figure 8:
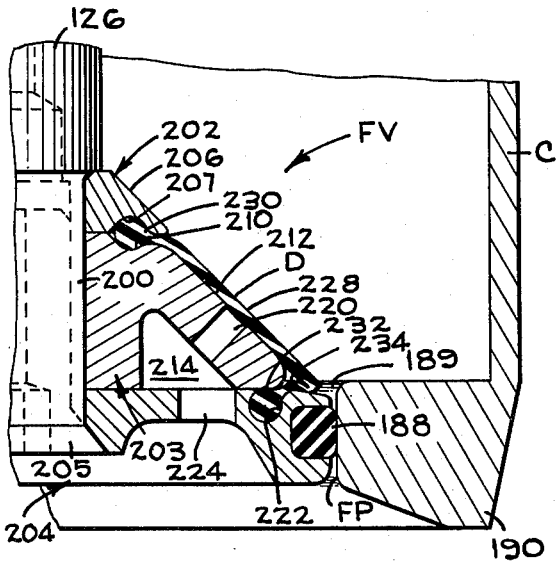
FIG. 8 is a partial section taken on line 8 — 8 of FIG. 7, with the diaphragm in place and lying flat against the conical upper wall of the foot valve.

FIGS. 7, 8 and 8A show the details of the preferred diaphragm type foot valve construction. As best seen in FIG. 8A, the foot valve actuating rod or stem 126 has its lower end necked down to form a shouldered sleeve 200 which is internally threaded. The foot valve is mounted on the sleeve 200 and comprises four major elements: an upper seat element 202, an intermediate diaphragm support element 203, a lower seat element 204 and the flexible diaphragm D. These elements are all clamped together and retained on the valve stem 126 by a conical head allen screw 205 threaded into the necked down sleeve 200 of the valve stem.

Describing the diaphragm parts in more detail, the upper seat element 202 has a conical outer face 206 for cooperating with a conical seat in the plug valve PV. A downwardly opening arcuate groove 207 is formed in the bottom wall of the upper seat element for mounting an inner diaphragm bead.

The intermediate support element 203 has an upwardly facing arcuate groove 210 complementary to the groove 207 for clamping the inner diaphragm bead. The member 203 is formed with a conical wall face 212 for supporting the diaphragm when it is in its flattened position, as shown in FIG. 8. The support 203 is machined to form a chamber 214 which communicates with air ports 216,218 and 220 for admitting atmospheric pressure to the underside of the diaphragm D.

The lower seat element 204 which receives the cylinder sealing O-ring 188, previously described, is formed with an upwardly facing arcuate groove 222 for mounting the outer bead of the diaphragm. The lower seat element 204 has a series of apertures 224 for communicating with the passage 214 in the support member 203 so that the underside of the diaphragm D is always at atmospheric pressure.

The diaphragm D is molded to provide a generally conical wall portion 228 which is of uniform thickness. In a valve designed to fill 2½ inch diameter cans, for example, the thickness of the wall portion 228 will be about 0.015 – 0.025 inches and the diameter of the centers of the outer beads 232 will be about 1⅛ inches. The diaphragm has a radially inner peripheral bead 230 which is clamped in the opposed arcuate grooves 207 and 210, previously described. The diaphragm D has an outer peripheral bead 232 which is clamped between the radially outer portion of the diaphragm support element 203 and the bead groove 222 formed in the lower seat element 204.

In order to augment the flexibility of the diaphragm and permit it to lay flat against the conical support seat 212 on the intermediate member under low pressures, as seen in FIG. 8 and to permit it to reach the distended position of FIG. 8A without requiring any substantial differential pressure across the diaphragm faces, the diaphragm is thinned out adjacent the outer bead 232, at 234, to provide an annular hinge. In the example given, the thickness of the diaphragm at the hinge portion 234 is in the order of 0.005 inches. FIG. 8 shows how the hinge portion 234 folds down and facilitates bringing the wall portion 228 of the diaphragm against the conical seat 212 of the intermediate element 203. Preferably, the diaphragm is formed of a heat resistant rubber.

When a significant pressure differential exists on opposite sides of the diaphragm, the diaphragm wall portion 228 has the curved configuration shown in FIG. 8A. When the pressure on the upper surface of the diaphragm exceeds atmospheric pressure by a slight amount, such as ⅛ – ¼ psig, the diaphragm will assume its flattened position shown in FIG. 8. Of course, when the foot valve FV engages the under conical surface of the plug valve PV, the diaphragm is flattened.

OPERATION

The operational sequence to be described is shown in FIGS. 9 through 20 and begins at FIG. 9, wherein the filling valve 20 has completed a filling operation and is ready for removal of the filled container and initiation of the various valve element motions required for a new filling cycle. Some angular positions of the filling valve 20 in FIG. 9 through 22 are indicated on FIG. 1.

END OF FILL

Referring to FIG. 9, the operational sequence under description begins at the end of the filling cycle for the can K, which occurs at about 245° of turret rotation. At this time in the cycle, the foot valve closing cam 92 starts raising the lower shoe 88 and hence starts raising the foot valve FV from its fully lowered, open position.

The plug valve PV was locked closed in an earlier portion (about 18°) of the operating cycle. Thus, the actuator rollers 144 (FIG. 6) are at this time supported by the stop 163 on the piston bracket 112 and are held in that position by the action of the spring 156 forcing the plug valve flange 142 downward against the tops of the rollers 144 (see FIG. 6) to fully close the plug valve PV in the piston P. As mentioned, the lower shoe 88 of the foot valve operator 85 is being raised by the foot valve closing cam 92 to slowly raise the foot valve toward the plug valve, and simultaneously, the cylinder roller 76 is ascending along the upper cam surface **74*c* of the cam 74** to raise the cylinder from the filled can. The piston P is bottomed in the cylinder C.

In FIG. 9, the piston is bottomed out in the cylinder and the entire filling valve assembly is suspended from the cylinder roller 76 by the upper edge **74*c* of cylinder lift cam 74. The cylinder C is at its lowermost position. The diaphragm D is shown as expanded to its convex condition, and is exposed to atmosphere on both faces because the foot valve FV is open. However, even if the diaphragm lays flat in the conditions of FIG. 9**, this will not effect its function under the present invention.

FOOT VALVE ENGAGES PLUG VALVE

FIGS. 10 and 10A illustrate the filling valve at about 248.5° on the turret and the cylinder C is rising to clear the can K and the cylinder is lifting the piston. The plug valve PV is still locked closed and hence is rising with the piston so that there is no motion of the plug valve relative to either the piston or the cylinder. However, the foot valve closing cam 92 has raised the shoe 88 of the foot valve operator 85 and has lifted the foot valve FV until it is nested with plug valve PV (FIG. 10). The diaphragm D is flattened against its underlying surface 212 (FIG. 8). No air has yet been trapped in the interstices between the foot and plug valves because the foot valve has not yet been raised sufficiently to cause its sealing ring 188 (FIG. 10A) to seal against the filling port sealing surface 189 of the cylinder C.

AIR TRAPPING

FIGS. 11 and 11A (at about 250.5°) disclose the first entrapment of atmospheric air in the various gaps and clearances that may exist between the plug valve sealing ring 182 and the foot valve sealing ring 188, the piston P and the cylinder C, as the foot valve rises and lifts the plug valve until both sealing rings 182, 188 are respectively seated against their cooperating sealing surfaces 184 and 189.

It should be noted that the amount of entrapped atmospheric air can vary according to dimensional machining variations among different valves.

TRAPPED AIR RELEASE

At about 252° (FIGS. 12 and 12A) the atmospheric air trapped between the foot and plug valve sealing rings 188, 182 is released to the measuring chamber MC to diffuse into the as yet unmeasured column of filling liquid therein. This occurs because the foot valve has been raised sufficiently by the foot valve closing cam 92 and the lower shoe 88 of actuator 85 (FIG. 9B) to unseat the plug valve PV from the piston P, until the plug valve sealing ring 182 (FIG. 12A) clears the sealing surface 184 of the piston. The foot valve sealing ring 188 still maintains its sealing engagement with the annular sealing surface 189 of the cylinder C. This lifting of the plug valve opens a path through the charging port 184 for the air formerly trapped at atmospheric pressure in the annular spaces between the valves to enter the liquid column in and above the measuring chamber MC.

PLUG VALVE OPENING

In FIG. 13 (at 266°) the plug valve opening cam 84 and roller 80 have lifted the plug valve PV almost to its fully open position relative to the piston P. The plug valve PV will subsequently be locked open at 271°. The upper surface **74*c* of the cam 74 and the roller 76 have lifted the cylinder C clear of the filled can K, the removal of which began slightly earlier in the cycle. The foot valve FV is in its closed position relative to the cylinder, as controlled by lower shoe 88 of the foot valve actuator 85 and the foot valve closing cam 92**. The foot valve FV is locked closed at 286°.

CYLINDER FULLY RAISED

At 288° of turret rotation the upper cam surface **74*c* has fully raised the cylinder roller 76. This cam surface remains level up to 330° during which time the cylinder remains in its fully raised position. However, the lower piston control surface 74*p* started to rise relative to the upper surface 74*c* back around 271° when the plug valve was locked open, so between 271° and 288° the piston roller 72 is moving closer to the cylinder roller 76**. Thus during this period of rotation, enlargement of the measuring chamber MC is taking place.

CYLINDER LOWERED

After 330° the cam face **74*c* begins to descend, thereby lowering the cylinder C and the foot valve FV (locked closed) into the newly presented empty container, which was transferred into the turret T at about 338.4°. As mentioned, the plug valve PV was locked open at 271° and the lower cam face 74*p* controlling the piston is approaching the upper cam face 74*c***, thereby continuing enlargement of the measuring chamber as both the cylinder and the piston are descending into the container.

The next illustrated phase, (FIG. 14) in the cycle occurs at 353° with the piston and cylinder almost fully separated while both are still being lowered into the empty can K and with the foot valve FV still closed and plug valve PV still fully open.

At about 0° (depending on the fill adjustment 172) the piston stop 159 (FIG. 6) engages the cylinder nut 172 and thereafter supports the cylinder, lifting its roller 76 slightly off the cam surface **74*c***. This establishes the selected volume of the measuring chamber and thereafter the cylinder and piston descend together.

Between 0° and about 11° the plug valve closing cam lowers the plug valve actuator 80 more rapidly than the cam surface **74*p* is lowering the piston and cylinder. This swings the rollers 144 (FIG. 6) from their locked or overcenter position toward the stop 163 on the cylinder, freeing the plug valve flange 142. The plug valve closing spring 156 can now lower the plug valve PV to the port 184** in the piston.

Figure 15:
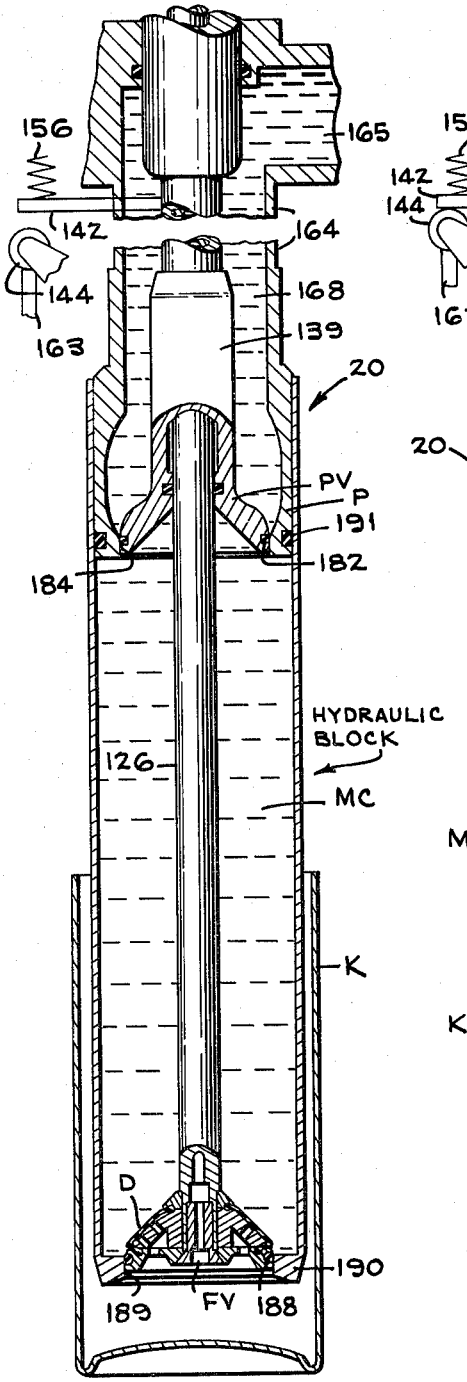
Figure 15A:
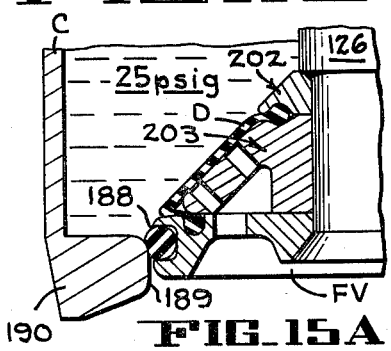
FIG. 15A is an enlarged sectional view of the lower left portion of the cylinder and foot valve shown in FIG. 15.

In FIGS. 15 and 15A, the first stage of a critical three stage operation occurs. The action that follows these stages involves the novel operation of the diaphragm D and the actions preceding diaphragm operation are summarized as follows:

HYDRAULIC BLOCK

FIGS. 15 and 15A depict a condition at about 15° of turret rotation wherein the cylinder C has been fully lowered and the piston P has been fully raised relative to the cylinder to its charge measuring position. The rollers 144 (FIG. 6) have been dropped down against the cylinder stop 163 and remain there for some time.

As diagramatically shown at the upper left of FIG. 15, the spring 156 is urging the plug valve flange 142 downwardly toward the rollers 144, which are resting on the plug valve bracket stop 163 (see phantom line position of FIG. 6). However, the plug valve O-ring 182 has just made sealing contact with the piston port 184, trapping the measured charge MC in the cylinder. This forms a hydraulic block which prevents further lowering of the plug valve PV into its fully seated position because of the substantial incompressibility of the measuring charge of liquid trapped in the measuring chamber MC. By way of example, when filling with carbonated beverages, such as beer, the gas pressure in the measuring charge will be at a pressure of about 25 psig.

DEBLOCKING

Figure 16:
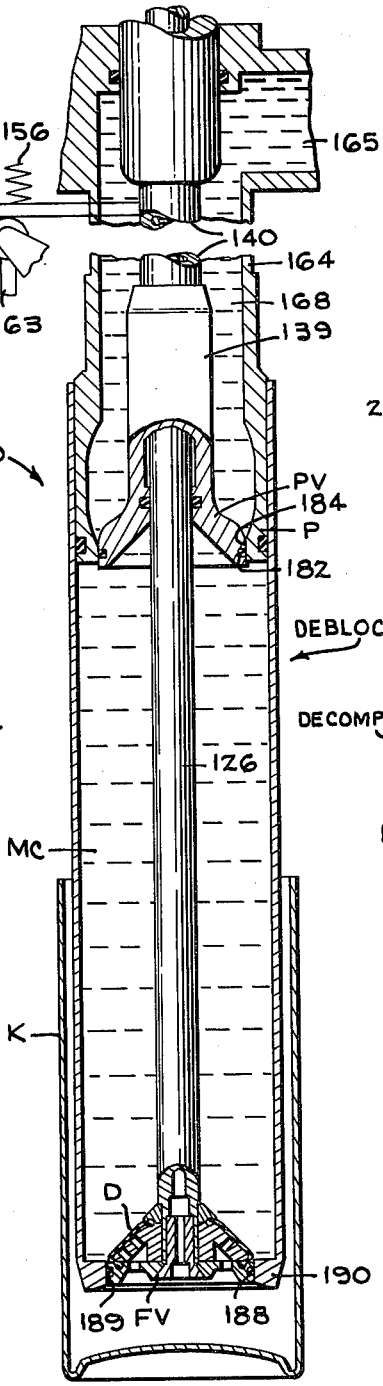
Figure 16A:
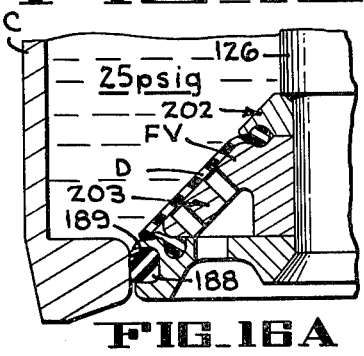
FIG. 16A is an enlarged section like that of FIG. 15A, but corresponding to FIG. 16.

FIGS. 16 and 16A shows completion of the removal of the hydraulic block (deblocking) after an initial stage of lowering the foot valve FV toward its open position. The gas pressure in the charge remains at the previous value of 25 psig., in the example given.

Actually, lowering of the foot valve from its previous sealed full up position began at about the 15° turret position shown in FIGS. 15 and 15A. Here the upper shoe 86 on the actuator 85 encountered the foot valve opening cam 90 (FIGS. 2 and 5) and the resultant clockwise rotation of the actuator caused a corresponding rotation of cranks 135 from their over-center or locked position (FIG. 6). The foot valve is unlocked at about 18° and further rotation of the actuator 85 initiates the lowering or opening motion of the foot valve.

In the present example, rotation of the turret from 15° (FIG. 15) to about 20° (FIG. 16) lowers the foot valve sufficiently to remove the aforesaid hydraulic block. As the foot valve is lowered during rotation from 15° to about 20°, the plug valve closing spring 156 causes the plug valve to lower and "follow" the lowering foot valve. This de blocking action is completed when the plug valve flange 142 is brought down against the previously lowered rollers 144, as illustrated diagramatically at the upper left of FIG. 16 and as shown in phantom lines in FIG. 6.

The plug valve PV has now been lowered sufficiently for the O-ring 182 to become fully seated in the sealing surface of the piston part 184. Since the foot valve FV is still seated (FIG. 16A) the measured charge is still trapped in the measuring chamber under a gas pressure of about 25 psig, in the present example. However, and as explained in the aforesaid Vadas patent, lowering of the foot valve continues, while it is still sealed with the cylinder port surface 189 to effect the "decompression stage".

DECOMPRESSION - SMALL MOTION REQUIRED

Figure 17:
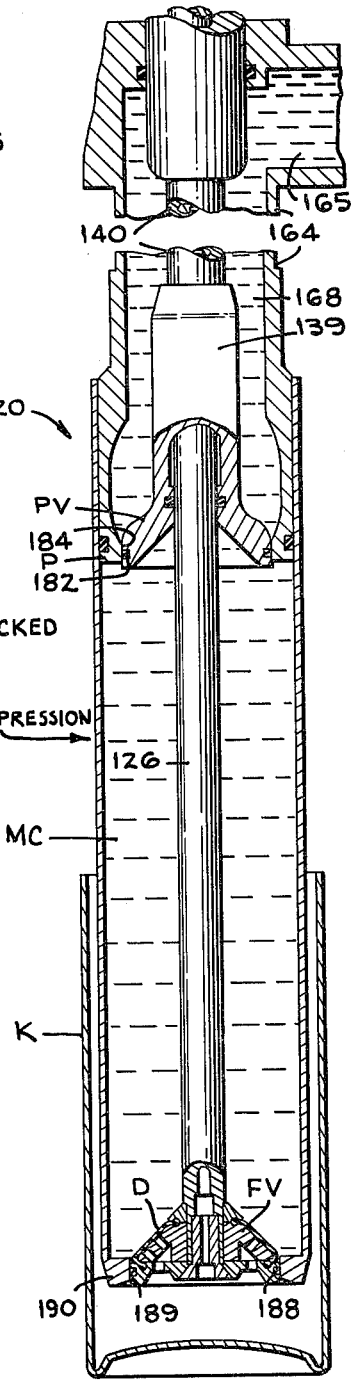
Figure 17A:
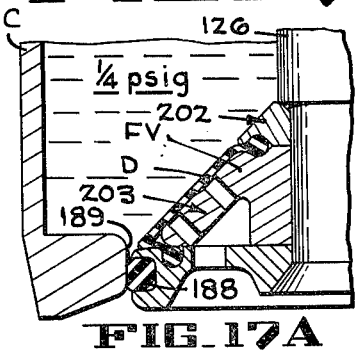
FIG. 17A is an enlarged section like that of 16A but corresponding to FIG. 17.

FIGS. 17 and 17A illustrate the completion of a stage wherein lowering of the foot valve FV has continued sufficiently from its deblocked position of FIG. 16 to decompress the gas in the measured charge down to atmospheric pressure. The remaining pressure of about ¼ psig indicated in FIG. 17A merely represents the pressure exerted on the diaphragm D by the weight of the liquid head of the charge above it, and this pressure is sufficient to hold the diaphragm flat. Ideally, the next increment of foot valve lowering would crack the valve open to initiate filling of the container without foaming, because the charge has been decompressed. However, and as seen in FIG. 17A, the foot valve has not been lowered sufficiently to open after decompression. This design is deliberate in order to provide tolerances for manufacturing variations and wear while insuring that the foot valve does not open before the end of the decompression stage. This would result in an initial pressurized discharge or "squirting" of the liquid out of the measuring chamber with a resultant foaming during fill.

DECOMPRESSION - LARGER MOTION

FIGS. 18 and 18A show termination of the decompression stage at about 30°, with a foot valve which had to be lowered further than the valve of FIG. 17, after the deblocking stage, to complete the decompression stage. This additional decompression motion can result from variations in clearances, machining accuracy, etc. between valves. This explains why provision is made for some additional foot valve lowering motion after the decompression stage before the foot valve is cracked open. It is this very requirement for additional foot valve lowering after completion of the decompression stage that presents the problem solved by the diaphragm type foot valve of the present invention.

It is to be noted that the diaphragm D has not had any operational function up to and including the decompression stages shown in FIGS. 17 and 19 and these stages are functionally the same as the corresponding stages described in the Vadas U.S. Pat. No. 3,949,791.

DIAPHRAGM ACTION - STAGE ONE

FIG. 19 shows the foot valve FV lowered to a position wherein its O-ring 188 is still sealed with the sealing surface 189 of the cylinder filling port FP but the foot valve is on the verge of cracking its seal with the cylinder port 189. In the present example, this represents an additional lowering of the foot valve from the positions of FIGS. 17 and 18 to the position of FIG. 19.

Were it not for the diaphragm D, the aforesaid additional enlargement of the measuring chamber would increase its volume sufficiently so that the liquid would not fully occupy the chamber, increasing the vapor space in the chamber, the pressure of which would be less than atmospheric. Now, were the foot valve to descend further and crack its seal sufficiently to discharge liquid, the aforesaid subatmospheric or vacuum conditions in the measuring chamber would present difficulties. Once the foot valve cracked open, the resultant pressure differential between the sub-atmospheric pressure in the measuring chamber MC and atmospheric pressure outside the chamber would initiate a rush of air up through the newly opened port, causing air bubbles to flow up into the measuring chamber, which would cause a foaming problem during filling.

However, the action of the diaphragm D equalizes the pressure within and outside of the measuring chamber and prevents the drawing of a vacuum in the measuring chamber, resulting in a substantially foamless filling operation.

As best seen in FIG. 19A, as lowering of the foot valve continues after the decompression stage up to the point where the foot valve just starts to open, the resultant enlargement of the measuring chamber beyond the capacity of the charge to fill it is compensated by the pressure of atmospheric air acting on the underside of the diaphragm D through the ports 216 - 220 formed in the foot valve FV. As a result, the diaphragm is distended, bulged or made to assume a convex form to an extent sufficient to compensate for the increase in measuring chamber volume caused by the continued lowering motion of the foot valve. As a result, the volume of the measuring chamber is held substantially constant and no subatmospheric or vacuum conditions are permitted to form in the measuring chamber. The only force that can be exerted on the foot valve diaphragm is the $\frac{1}{8}$ - $\frac{1}{4}$ psig pressure representing the height of the liquid column in the measuring chamber. This pressure is so small as to have an insignificant effect on the diaphragm distension action which prevents drawing a vacuum in the measuring chamber. The thinned down hinge section 234 molded into the diaphragm decreases resistance of the diaphragm material to the aforesaid distension or bulging under differential pressure conditions, with the corresponding prevention of the development of sub-atmospheric pressure conditions within the measuring chamber.

DIAPHRAGM ACTION - STAGE TWO

FIG. 20 shows a second stage in the action of the diaphragm wherein the foot valve has been further lowered from the position of FIG. 19. This additional foot valve lowering is sufficient to cause the foot valve O-ring 188 to just break its seal with the filling port FP of the cylinder. The degree of foot valve opening shown in FIG. 19 is small enough so that the charge forms a liquid meniscus in the very small port just formed, and the charge has not yet started to flow out of the measuring chamber. Under these conditions, air does not flow up into the measuring chamber through the meniscus at the cracked seal, and hence the charge is "suspended" in the measuring chamber and may exert even less than the $\frac{1}{8}$ - $\frac{1}{4}$ psig pressure due to the weight of the charge indicated in FIG. 20A.

The additional lowering motion of the foot valve just described and illustrated in FIGS. 20 and 20A has been compensated for by additional distension or bulging of the diaphragm D by atmospheric pressure acting on the underside of the diaphragm. Thus as lowering of the foot valve continues after the 36° turret position of FIGS. 20 and 20A, in order to open the valve sufficiently to initiate container filling, the diaphragm action will have insured that no sub-atmospheric pressure conditions existed and hence air bubbles will not flow up into the measured charge and cause foaming problems during filling. Experience has shown that when the foot valve has just cracked its seal, liquid will not flow out of the measuring chamber until the piston and plug valve are lowered from their uppermost positions.

FILL STARTS

Figure 21:
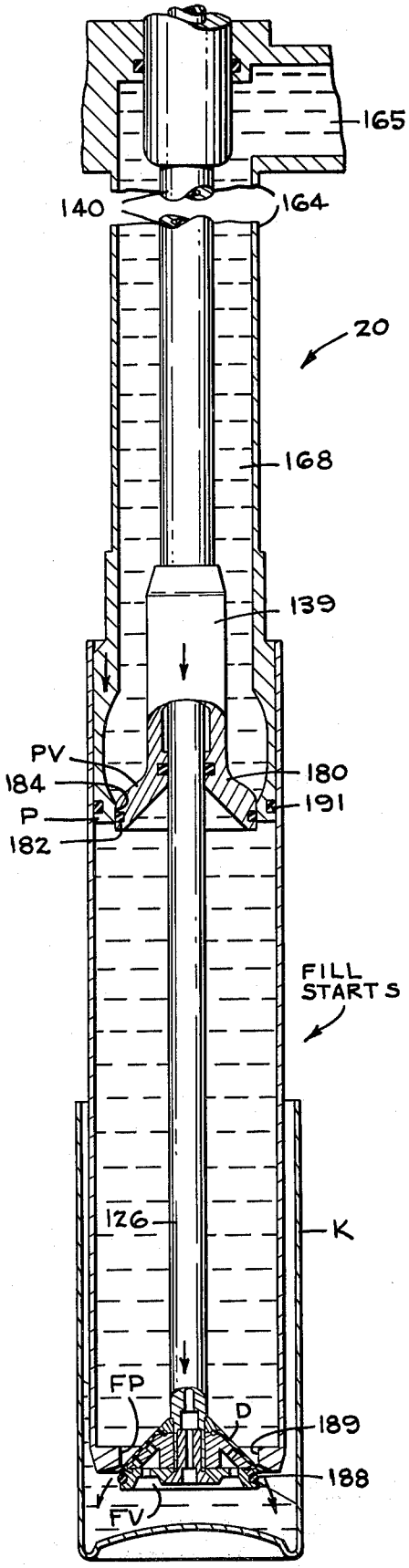

FIG. 21 shows conditions at about 40° of turret rotation just after the fill starts. The lower cam surface **74*p* has started to lower the piston along with the plug valve, which remains locked closed. The foot valve opening cam 90 has acted on the upper actuator shoe 86 to continue lowering of the foot valve below the just cracked, meniscus position shown in FIGS. 20 and 20A. Liquid now flows out of the measuring chamber into the can K, as indicated in FIG. 21**.

CONTINUE FILL

Figure 22:
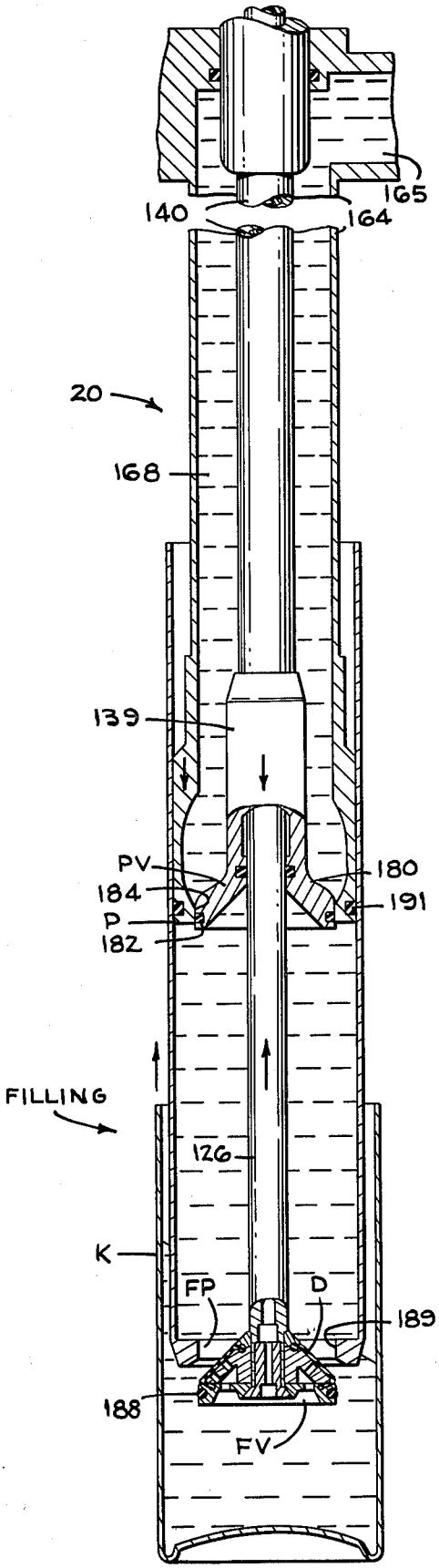

FIG. 22 illustrates a continuation of the can filling step at about 120° of turret rotation. The can is about $\frac{1}{3}$ full and centrifugal force has caused the surface of the liquid in the can to incline, as illustrated. At about this point the can support elements such as platform 64 and rail 65 (FIG. 2) are formed so as to initiate banking of the can to prevent spillage, in accordance with known procedures in this art.

The cylinder C is being raised, to retract it from the can by the upper cam surface **74*c* and the cylinder roller 76. Simultaneously the piston and the plug valve (locked closed) are being lowered by the lower cam surface 74*p***. Thus the measuring chamber is being collapsed to expel the charge into the can.

At 245° the valve has returned to the position of FIGS. 9 and 9B, and the fill is complete with the piston bottomed out in the cylinder.

Thus it can be seen that the filler of the present invention, wherein the foot valve is provided with distensible means, such as a diaphragm, will perform the essential plug valve deblocking and charge decompression operations of prior devices and will do so without premature foot valve opening and without drawing a vacuum due to opening motion of the foot valve after the decompression stage. As a result, the filler of the present invention will provide a substantially foam free filling operation for carbonated beverages, such as beer or the like.

Even if the liquid were not carbonated or had no gas therein, the pressure equalizing foot valve of the present invention would have an important function in that it would preclude the drawing of a vacuum in the measuring chamber if the measuring chamber were enlarged by opening motion of the foot valve before the latter opens to initiate filling of a container.

It should be understood that in the specification and claims references to "vacuum" and "atmospheric pressure" are employed with respect to the ambient atmospheric pressure. For example, if the filler valve were operating in a pressurized or sub-atmospheric room or chamber, the "atmospheric" pressure would be the air pressure in the room or chamber.

Similarly, if the valve is sealed with a container and the container is pressurized during the filling cycle, the "atmospheric" pressure referred to would be the pressure in the container. As a corollary, if the container were vacuumized during the filling cycle, the "atmospheric" pressure referred to would be the sub-atmospheric pressure in the container.

As can be seen, the above examples all refer to gauge pressures and if the reference pressures were absolute pressures, there would be no qualitative differences between the examples, only quantitative.

Under some conditions and with some liquids it might be desirable to have a selected predetermined absolute pressure on the liquid in the measuring chamber at the time that the foot valve opens. In this case the selected absolute pressure would be applied to the outside surface of a movable pressure equalizing element, the inside surface of which is exposed to the liquid in the measuring chamber. Thus, just as the foot valve opens, the equalizing element would bring the absolute pressure in the measuring chamber to the aforesaid selected absolute pressure.

Although the best mode contemplated for carrying out the present invention has been herein shown and described, it will be apparent that modification and variation may be made without departing from what is regarded to be the subject matter of the invention as defined in the appended claims.

I claim:

1. A filler for filling open top containers and comprising a measuring chamber and valve assembly in communication with a liquid reservoir; said assembly being of the type comprising a cylinder element having a bottom wall formed with a container filling port, a foot valve element for closing and opening said filling port, a measuring piston element slidable in said cylinder element and having a bottom wall formed with a measuring chamber charging port, and a plug valve element for opening and closing said charging port, said foot and plug valve elements having walls with opposed complementary surfaces; element operation means comprising means for closing said foot valve element, means for charging said measuring chamber from the reservoir by moving both said piston and plug valve elements relative to said cylinder element in a chamber enlarging direction while the foot valve element is closed and the plug valve element is open, means for discharging liquid from said measuring chamber into a container by closing said plug valve element and in opening said foot valve element and then moving both said piston and plug valve elements relative to said cylinder element in the chamber collapsing direction; the improvement comprising anti-vaccum means freely movable in said foot valve for holding the volume of said measuring chamber substantially constant as said foot valve is lowered, said anti-vacuum means having an upper face exposed to said measuring chamber charge and a lower face that is exposed to the atmosphere; said anti-vacuum means being held in a retracted position by the pressure of gas trapped in the charge and the weight of the charge in said measuring chamber during an initial stage of foot valve opening movement which brings the pressure within the measuring chamber substantially down to atmospheric pressure while the foot valve is still closed, said anti-vacuum means being projected into the measuring chamber by atmospheric pressure acting on the lower face thereof by a distance sufficient for holding the volume of the measuring chamber substantially constant and thus preventing the drawing of a vacuum in said measuring chamber as said foot valve element opening movement continues after pressure of the gas trapped in the measuring chamber liquid has been brought down to atmospheric pressure.

2. A filler for filling open top containers and comprising a measuring chamber and valve assembly in communication with a liquid reservoir; said assembly being of the type comprising a cylinder element having a bottom wall formed with a container filling port, a foot valve element for closing and opening said filling port, a measuring piston element slidable in said cylinder element and having a bottom wall formed with a measuring chamber charging port, and a plug valve element for opening and closing said charging port, said foot and plug valve elements having walls with opposed complementary surfaces; element operating means comprising means for closing said foot valve element, means for charging said measuring chamber from the reservoir by moving both said piston and plug valve elements relative to said cylinder element in a chamber enlarging direction while the foot valve element is closed, and the plug valve element is open, means for discharging liquid from said measuring chamber into a container by closing said plug valve element and opening said foot valve element and then moving both said piston and plug valve elements relative to said cylinder element in the chamber collapsing direction; the improvement comprising a flexible diaphragm, means for peripherally sealing said diaphragm to said wall of said foot valve element with the upper face of said diaphragm exposed to said measuring chamber charge, and port means formed in said wall for exposing the lower face of said diaphragm to the atmosphere; said diaphragm being held flat against said plug valve element wall by the pressure of gas trapped in the charge and the weight of the charge in said measuring chamber during an initial stage of foot valve opening movement which brings the pressure within the measuring chamber substantially down to atmospheric pressure while the foot valve is still closed, said diaphragm being sufficiently flexible and distensible for causing atmospheric pressure acting on the lower face of said diaphragm to distend the diaphragm from said wall and prevent the drawing of a vacuum in said measuring chamber as said foot valve element opening movement continues.

3. The filler of claim 2, wherein said cylinder and foot valve elements and said piston and plug valve elements have cooperating cylindrical seating surfaces.

4. The filler of claim 2, wherein said diaphragm is an annulus of elastomeric material and is sealed to said foot valve wall at its inner and outer peripheral edges.

5. The filler of claim 4, wherein said diaphragm is formed with a recurved section adjacent one edge for providing a flexible hinge portion between the main wall of the diaphragm and the associated edge.

6. The filler of claim 5, wherein said recurved portion is thinner than the main wall of the diaphragm.

7. The filler of claim 6, wherein said hinge portion is adjacent the outer peripheral edge of the diaphragm.

8. The filler of claim 4, wherein the edges of said diaphragm are formed with enlarged beads, and said foot valve element comprises means for clamping said beads.

9. The filler of claim 4, wherein the portion of said foot valve element wall that underlies said diaphragm has a shape complementary to that of the opposed plug valve element wall but is inwardly offset from adjacent surfaces of said foot valve element wall so that when said diaphragm lies flat on the wall its outer surface forms a continuation of said adjacent wall surfaces.

10. The filler of claim 9, wherein said portion of the foot valve wall element is conical.

11. A filler for filling open top containers and comprising a measuring chamber and valve assembly in communication with a liquid reservoir; said assembly being of the type comprising a cylinder element having a bottom wall formed with a container filling port, a foot valve element for closing and opening said filling port, a measuring piston element slidable in said cylinder element and having a bottom wall formed with a measuring chamber charging port, and a plug valve element for opening and closing said charging port; said foot and plug valve elements having walls with opposed complementary surfaces; element operation means comprising means for closing said foot valve element, means for charging said measuring chamber from the reservoir by first opening said plug valve element and then moving both said piston and plug valve elements relative to said cylinder element in a chamber enlarging direction while the foot valve element is closed, means for discharging liquid from said measuring chamber into a container by closing said plug valve element and opening said foot valve element and then moving both said piston and plug valve elements relative to said cylinder element in a chamber collapsing direction; said foot valve element opening movement comprising a short stage of hydraulic deblocking movement that permits the plug valve element to reach its fully seated position, a short stage of decompressing movement that slightly enlarges the measuring chamber for lowering the pressure of gas trapped therein to atmospheric pressure while the foot valve remains closed, and a stage of movement that just opens the foot valve element; the improvement comprising a flexible diaphragm, means for peripherally sealing said diaphragm to the wall of said foot valve element with the upper face of said diaphragm exposed to said measuring chamber charge, and port means formed in said wall for exposing the lower face of said diaphragm to the atmosphere; said diaphragm being held flat against said plug valve element wall by the pressure of gas trapped in the charge in said measuring chamber during said deblocking movement, said diaphragm remaining flat against said wall under the weight of the charge upon completion of said decompressing movement which brings the pressure of the trapped gas down to substantially atmospheric pressure while the foot valve is still closed, said diaphragm being sufficiently flexible and distensible for causing atmospheric pressure acting on the lower face of said diaphragm to distend the diaphragm from said wall for maintaining the trapped gas in said measuring chamber at atmospheric pressure as lowering of the foot valve continues until the valve is just open.

12. The filler of claim 11, wherein said cylinder and foot valve elements and said piston and plug valve elements have cooperating seating surfaces.

13. The filler of claim 11, wherein said diaphragm is an annulus of elastomeric material and is sealed to said wall at its inner and outer peripheral edges.

14. The filler of claim 13, wherein said diaphragm is formed with a recurved section adjacent one edge for providing a flexible hinge portion between the main wall of the diaphragm and the associated edge.

15. The filler of claim 14, wherein said recurved portion is thinner than the main wall of the diaphragm.

16. The filler of claim 14, wherein said hinge portion is adjacent the outer peripheral edge of the diaphragm.

17. The filler of claim 13, wherein the edges of said diaphragm are formed with enlarged beads, and said foot valve element comprises means for clamping said beads.

18. The filler of claim 13, wherein the portion of said foot valve element wall that underlies said diaphragm has a shape complementary to that of the opposed plug valve element wall and is inwardly offset from adjacent surfaces of said foot valve element wall so that when said diaphragm lies flat on the wall its outer surface forms a continuation of said adjacent wall surfaces.

19. The filler of claim 18, wherein said portion of the foot valve element wall is conical.

20. A filler for filling open top containers and comprising a measuring chamber and filling valve assembly in communication with a liquid reservoir; said assembly being of the type comprising a cylinder element having a bottom wall formed with a container filling port having a cylindrical seating surface, a foot valve element having a seating surface cooperable with that of said cylinder element port for partially defining a measuring chamber, a measuring piston element slidable in said cylinder element and having a measuring chamber charging port with a cylindrical seating surface, a plug valve element having a seating surface cooperable with that of said piston element for opening said charging port during charging of said measuring chamber from the reservoir and for closing the charging port to define said measuring chamber when said foot valve element is closed before initiating container filling, said foot and plug valve elements having opposed complementary conical walls; element operating means comprising means for closing said foot valve element; means for then opening said plug valve element relative to said piston element to provide a charging port for said measuring chamber, means for then moving both said piston and plug valve elements relative to said cylinder and foot valve elements in a chamber enlarging direction until the measuring chamber has received a full charge from the reservoir; means for opening said foot valve element, and means for moving both said piston and plug valve elements relative to said cylinder and foot valve elements in the opposite direction for expelling the charge from said measuring chamber; the improvement comprising a flexible diaphragm, means for peripherally sealing said diaphragm to said wall of said foot valve element with the upper face of said diaphragm exposed to said measuring chamber charge, and port means formed in said wall for exposing the lower face of said diaphragm to the atmosphere; said diaphragm being held flat against said foot valve element wall by the weight of the charge and the pressure of gas trapped in said measuring chamber during a deblocking stage of the foot valve element opening movement which fully seats the plug valve; said diaphragm being held flat against said wall by the weight of the charge upon completion of a decompression stage of the foot valve element opening movement which enlarges said measuring chamber sufficiently to bring the pressure of the trapped gas down to atmospheric pressure; said diaphragm being formed of rubber-like materials and being formed with a recurved section of reduced thickness adjacent its outer peripheral edge for rendering said diaphragm sufficiently flexible and distensible to cause atmospheric pressure acting on the lower face of said diaphragm to distend the diaphragm from said wall and maintain the previous volume of said measuring chamber, thus holding the trapped gas in said chamber at substantially atmospheric pressure, during an initial stage of foot valve element opening movement that follows said decompression stage.

21. In a liquid filler for filling open top containers and including a vertically disposed measuring chamber and filling valve assembly comprising a cylinder element having a bottom wall formed with a container filling port having a cylindrical seating surface; means for supplying filling liquid under pressure to said cylinder element, a foot valve element having a peripheral seating surface cooperable with said cylinder element port for controlling the discharge of liquid from said filling valve, a piston element slidable in said cylinder element and having a charging port and a plug valve element for said charging port, and means of operating said elements; the improvement wherein said foot valve element is provided with a generally radial perforate wall, the underside of said foot valve being exposed to atmosphere, a flexible circular diaphragm overlying said perforations and peripherally sealed to said foot valve element, said element operating means moving said foot valve downward, while sealed to said cylinder, for decompressing gas trapped in a filling charge in said cylinder down to substantially atmospheric pressure, additional downward movement of said foot valve element, while still sealed with the cylinder element, causing said diaphragm to distend sufficiently under atmospheric pressure so that the pressure of any gas in the liquid filling charge is held at substantially atmospheric pressure before the foot valve opens sufficiently to dispense the filling charge.

22. For use in an open top container filler of the type having a cylinder with a fill port, a foot valve for the fill port, a piston slidable in said cylinder and having a charging port controlled by a plug valve and means for supplying liquid to said cylinder; an annular diaphragm for said foot valve formed of rubber-like material, said diaphragm having peripheral inner and outer mounting beads for clamp means on the foot valve, a flexible main wall portion extending radially outwardly from said inner bead substantially up to said outer bead, and a narrow annular recurved section joining said main wall portion to said outer bead, said recurved section being thinner than said wall portion to facilitate free distension of the diaphragm into the cylinder under atmospheric pressure when pressure in the cylinder falls below atmospheric pressure.

23. A filler for filling open top containers with a liquid, said filler comprising a measuring chamber and valve assembly in communication with a liquid reservoir; said assembly having a cylinder element with a container filling port, a foot valve element for closing and opening said filling port and which remains sealed with said port during an initial opening stage of the valve element, a piston in said cylinder element having a charging port, a plug valve for opening said charging port and for closing said charging port to form the measuring chamber and means for opening said filling port while said piston remains stationary; the improvement comprising a pressure equalizing device, means for mounting said device in one of said elements for free motion relative to said element while maintaining a seal therewith, said device having an inner surface which forms a portion of the inner wall of the measuring chamber and an opposed outer surface exposed to a predetermined external ambient pressure, said pressure equalizing device being freely moveable into the measuring chamber in response to the pressure differential created across its outer and inner surfaces by the decrease in pressure on its inner surface that occurs during an initial opening movement of said foot valve element that takes place while the piston remains stationary with a consequent slight enlargement of said measuring chamber, for causing said pressure equalizing device to equalize the pressure in the measuring chamber with said predetermined ambient pressure as said foot valve opens.

24. The filler of claim 23, wherein said pressure equalizing device is mounted on said foot valve.

25. A filler for filling open top containers comprising a measuring chamber and valve assembly in communication with a liquid reservoir; said assembly having a cylinder element with a container filling port, a foot valve element for closing and opening said filling port and which remains sealed with said port during an initial opening stage of the valve element, a piston element in said cylinder element having a charging port, a plug valve element for opening and closing said charging port; the improvement comprising an anti-vacuum element with one surface comprising a portion of the inner surface of the measuring chamber, means for mounting said anti-vacuum element on a wall that defines said measuring chamber so as to be freely moveable into the measuring chamber while maintaining sealing engagement therewith to prevent a vacuum from being formed in the measuring chamber during the initial opening stage of said foot valve.

26. The method of filling open top containers with a liquid containing dissolved gas under pressure, said method being of the type which comprises the steps of trapping a measured charge of the liquid under pressure in a measuring chamber defined by a cylinder having a filling port that is closed by a foot valve and a piston slidable in the cylinder and having a charging port that is closed by a plug valve, moving the foot valve toward its open position during a decompression stage while the valve still closes the filling port to enlarge the measuring chamber sufficiently to decompress the gas in the measured charge of trapped liquid down to atmospheric pressure and thereafter opening the foot valve for discharging liquid from the measuring chamber into a container; the improvement comprising the step of moving a pressure equalizing element into the measuring chamber sufficiently to maintain the volume of the measuring chamber substantially constant while the piston is stationary and as the foot valve is moved still further toward its open position after termination of the decompression stage but while the foot valve still closes the filling port and before the discharge of the measured charge of liquid from the measuring chamber begins, for preventing reduction of the pressure in the measuring chamber to sub-ambient pressure during said further opening motion of the foot valve.

27. The method of claim 26, comprising the steps wherein the motion of said pressure equalizing element into the measuring chamber is controlled by continuously sensing the difference between the reduced pressure in said measuring chamber and atmospheric pressure caused by said foot valve opening motion, and employing said pressure differential to move said equalizing element into the measuring chamber until the pressure in the chamber is substantially equal to ambient pressure.

* * * * *

UNITED STATES PATENT OFFICE

CERTIFICATE OF CORRECTION

Patent No. 4,099,547 Dated July 11, 1978

Inventor(s) SHERMAN H. CREED

It is certified that error appears in the above-identified patent and that said Letters Patent are hereby corrected as shown below:

Abstract of Disclosure line 6 - second col. change "all" to --wall--.

Col. 18, line 41, change "19" to --18--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*